US006398029B1

(12) United States Patent
Farison et al.

(10) Patent No.: US 6,398,029 B1
(45) Date of Patent: Jun. 4, 2002

(54) PACKAGING CUSHION AND PACKAGING ASSEMBLIES INCORPORATING SAME

(75) Inventors: Brian Kent Farison, Gaylordsville; Kenneth P. Chrisman, Monroe, both of CT (US); Drew O. DaHarb, Seattle, WA (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 0 days.

(21) Appl. No.: 09/527,332

(22) Filed: Mar. 17, 2000

(51) Int. Cl.[7] ..... B65D 81/02
(52) U.S. Cl. ..... 206/522; 206/592; 383/3
(58) Field of Search ..... 206/522, 585–587, 206/591–594, 499, 320; 383/3

(56) References Cited

U.S. PATENT DOCUMENTS

| | | | | |
|---|---|---|---|---|
| 1,457,496 A | | 6/1923 | Butler | |
| 3,089,153 A | | 5/1963 | Bosc | |
| 3,346,101 A | | 10/1967 | Pestka | |
| 3,366,231 A | | 1/1968 | Trakas | |
| 3,398,501 A | | 8/1968 | Aninger | |
| 3,889,743 A | | 6/1975 | Presnick | |
| 4,235,065 A | | 11/1980 | Freeman | |
| 4,739,884 A | | 4/1988 | Duplessy | |
| 4,874,093 A | | 10/1989 | Pharo | |
| 4,905,835 A | | 3/1990 | Pivert et al. | |
| 4,979,620 A | | 12/1990 | Delamare et al. | |
| 5,005,702 A | | 4/1991 | Davis et al. | |
| 5,134,930 A | | 8/1992 | Mei-Hwa | |
| 5,139,153 A | | 8/1992 | Delamare et al. | |
| 5,180,060 A | | 1/1993 | Forti et al. | |
| 5,348,157 A | | 9/1994 | Pozzo | |
| 5,351,829 A | | 10/1994 | Batsford | |
| 5,445,274 A | | 8/1995 | Pharo | |
| 5,454,642 A | | 10/1995 | DeLuca | |
| 5,469,966 A | | 11/1995 | Boyer | |
| 5,570,778 A | | 11/1996 | Batsford | |
| 5,588,533 A | | 12/1996 | Farison et al. | |
| 5,620,096 A | | 4/1997 | Pozzo | |
| 5,622,262 A | | 4/1997 | Sadow | |
| 5,624,035 A | * | 4/1997 | Kim | 206/522 |
| 5,626,229 A | | 5/1997 | Dickie et al. | |
| 5,628,402 A | | 5/1997 | Dickie et al. | |
| 5,727,270 A | | 3/1998 | Cope et al. | |
| 5,755,329 A | | 5/1998 | Sadow | |
| 5,762,270 A | | 6/1998 | Farison | |
| 5,769,231 A | * | 6/1998 | Batsford | 206/522 |
| 5,803,263 A | | 9/1998 | Pozzo | |
| 5,819,942 A | | 10/1998 | Sadow | |
| 5,830,780 A | | 11/1998 | Dennison et al. | |
| 5,846,620 A | | 12/1998 | Compton | |
| 5,862,914 A | | 1/1999 | Farison et al. | |
| 6,076,677 A | * | 6/2000 | Pozzo | 206/522 |

FOREIGN PATENT DOCUMENTS

| | | |
|---|---|---|
| FR | 1371316 | 7/1964 |
| FR | 2385606 | 10/1978 |
| WO | WO 96/22926 | 8/1996 |

* cited by examiner

*Primary Examiner*—Luan K. Bui
(74) *Attorney, Agent, or Firm*—Lerner, David, Littenberg, Krumholz & Mentlik, LLP

(57) ABSTRACT

A packaging assembly is disclosed in which an article is supported in a suspended position in an outer container during shipping. The article is sandwiched between a pair of cushions, each cushion including a noninflated central web and a pair of inflated sidewalls and end walls. The sidewalls and end walls of the bottom cushion project away from the central web downwardly and outwardly toward the bottom edges of the outer container. The sidewalls and end walls of the upper cushion project away from the central web upwardly and outwardly toward the top edges of the outer container. The sidewalls and end walls of the two cushions together define flexible arches which project in all of the orthogonal directions of the outer container, protecting the article against an impact force in any direction.

42 Claims, 11 Drawing Sheets

PACKAGING CUSHION AND PACKAGING ASSEMBLIES INCORPORATING SAME

FIELD OF THE INVENTION

The present invention relates to packaging materials and, more particularly, to packaging cushions. Still more particularly, the present invention relates to inflatable packaging cushions which may be used to package one or more objects in suspended positions within an outer container.

BACKGROUND OF THE INVENTION

Protective packaging structures are often used to protect an article from physical shock during shipping and storage. For example, when shipping articles which may be relatively fragile, it is often desirable to package the article inside a box to protect the article from physical impact to the box which may occur during loading, transit and unloading. Aside from the shipping box itself, some additional structures are ordinarily needed to prevent the article from being damaged by uncontrolled movement within the box. Such additional structures have included paper or plastic dunnage, molded plastic foams, cotton batting and foam-filled cushions, among others.

One useful form of packaging for especially fragile articles is referred to as suspension packaging, examples of which are disclosed in U.S. Pat. No. 4,852,743 to Lewis H. Ridgeway and U.S. Pat. No. 5,388,701 to Devin C. Ridgeway. In suspension packaging, the article is suspended between two confronting sheets of plastic film. The sheets are usually attached to frames formed from a rigid material and sized to fit securely within a selected size box, two frames being used for each box. Each frame includes side and end legs which may be folded away from the film so as to space the film from the top and bottom of the box. The fact that the article is not in contact with any substantially rigid surfaces protects it from physical shock. However, the fact that the frame is formed from a different material than the sheets of plastic complicates the manufacturing process. Moreover, there is a possibility for the plastic sheet to become detached from the frame under extreme conditions. Also, the need to assemble the frames before they are inserted into an outer box adds to packaging time and expense.

In seeking better protective packaging materials, various of air inflatable cushions have been suggested. Examples of inflatable cushions are disclosed in U.S. Pat. No. 5,348,157 to Pozzo. In one embodiment disclosed therein, a cushion having a single chamber is designed to provide protection on four sides of a box. In another embodiment, the inflatable chamber extends around the entirety of the article.

In another example, U.S. Pat. No. 5,180,060 to Forti et al. discloses an inflatable packaging insert that is positioned around the sides of an article placed in a closed box. This inflatable packaging insert provides articulated panels having opposed edge portions for forming corners. According to one embodiment, a pair of opposed V-shaped or triangular inserts forming a gusset allow the inflatable packaging insert, when inflated, to securely engage the corners of the article. A single valve is used to inflate each of the chambers encircling the article.

In yet another example of inflatable packaging material, U.S. Pat. No. 4,905,835 to Pivert et al. discloses an inflatable package cushioning system which utilizes two separate inflatable cushions to protect all six sides of a box or article. Each of the cushions has articulated sides which fold to protect three sides of the article. U.S. Pat. No. 3,889,743 to Presnick discloses inflatable insulation for packaging including an inflatable cushion having a single inflation valve and articulated portions capable of protecting all six sides of a rectangular box. In addition, there are disclosed horizontal folding straps placed across at least one and advantageously two vertical lines of articulation of the liner.

All of the inflatable cushioning structures described above require some degree of assembly to package an article in an outer container, which assembly is often cumbersome and time consuming. Furthermore, all of the foregoing structures rely solely upon compression of the cushion in order to support the packaged article and prevent it from being damaged. Overcompression of the cushion during handling of the package may cause the cushion to burst, thereby destroying its protective properties.

In view of the drawbacks in the protective packaging of the prior art, there exists a need for improved packaging structures which are easy to manufacture and use, which are highly reliable, and which provide a high degree of support and protection to an article during shipping.

SUMMARY OF THE INVENTION

The present invention addresses these needs.

One aspect of the present invention provides a packaging cushion for supporting at least one article. The packaging cushion includes a central portion extending generally in a horizontal plane and having an upwardly facing surface adapted to support the article. A plurality of resilient cushioning members each has one edge connected to the central portion and a free edge spaced from the central portion. Each cushioning member projects away from the central portion at an oblique angle, the oblique angles each having a first component extending parallel to the horizontal plane and a second component projecting downwardly from the horizontal plane. In preferred embodiments, the first and second components of the oblique angles may be about equal. Each of the cushioning members preferably is separated from an adjacent cushioning member by a gap so that it is movable away from the adjacent cushioning member. The gaps may extend inwardly from the free edges of the cushioning members toward the central portion of the cushion.

Each cushioning member may include a hollow chamber containing a filler medium, preferably air. The hollow chamber in each cushioning member may be in flow communication with the hollow chamber in adjacent cushioning members. An access port may be provided for supplying the filler medium to the hollow chamber in each one of the cushioning members.

The central portion of the cushion may include at least one web of material interconnecting the cushioning members and adapted to support the article. The web of material may include a plurality of apertures formed therein or, alternatively, may include at least one slit dividing the web into first and second portions adapted to receive the article therebetween.

In preferred embodiments, the free edge of at least one of the cushioning members may have end portions spaced from the central portion of the cushion by a first distance and an intermediate portion between the end portions spaced from the central portion by a distance less than the first distance. In highly preferred embodiments, the intermediate portion may define a smooth arch.

In a variant of this aspect of the invention, the cushioning members may be inflatable, and may have a noninflated condition and an inflated condition. In the inflated condition, the cushioning members project away from the central portion at an oblique angle having a first component extending parallel to the horizontal plane and a second component projecting downwardly from the horizontal plane.

Another aspect of the present invention provides a packaging assembly. The packaging assembly includes a container having a sidewall, a bottom panel connected to the sidewall along a bottom edge, and a top panel connected to the sidewall along a top edge. A packaging cushion having any of the structural features described above may be disposed in the container so as create to a void space between the central portion of the cushion and the bottom panel of the container. At least one article may be supported on the central portion of the cushion, whereby the article will be spaced from the bottom panel of the container.

In preferred embodiments hereof, the oblique angles formed by some of the cushioning members may include a horizontal component extending in the length direction of the container, and the oblique angles formed by other cushioning members may include a horizontal component extending in the width direction of the container. In other preferred embodiments, the cushion may include a pair of cushioning members each projecting away from the central portion toward the side panels of the container and another pair of cushioning members each projecting away from the central portion toward the end panels of the container.

Yet a further aspect of the present invention provides a packaging assembly including a container have a sidewall, a bottom panel connected to the sidewall along a bottom edge and a top panel connected to the sidewall along a top edge. A first cushion is disposed in the container so that its cushioning members project from a central portion thereof at oblique angles having a first component extending parallel to a horizontal plane and a second component projecting downwardly from the horizontal plane so as to create a void space between the central portion of the cushion and the bottom panel of the container. A second cushion is disposed in the container so that its cushioning members project from the central portion thereof at oblique angles having a first component extending generally parallel to the horizontal plane and a second component projecting upwardly from the horizontal plane so as to create a void space between the central portion and the top panel of the container. At least one article is positioned between the central portions of the first and second cushions so that the article is spaced from the top and bottom panels of the container.

In other preferred embodiments in accordance with this aspect of the invention, the free edge of each of the cushioning members in the first cushion may have end portions spaced from the central portion thereof by selected distances and an intermediate portion between the end portions spaced from the central portion thereof by a distance less than the selected distances. The cushioning members in the second cushion desirably are similarly structured. In highly preferred embodiments, the intermediate portions in both the first and second cushions define smooth arches.

A still further aspect of the present invention provides a packaging assembly including a container having a sidewall, a bottom panel connected to the sidewall along a bottom edge, and a top panel connected to the sidewall along a top edge. The packaging assembly further includes a series of cushions arranged one on top of another to form a stack in the container. Each cushion in the stack is oriented so that its cushioning members project at oblique angles to the central portion of the cushion, the oblique angles each having a first component extending parallel to a horizontal plane and a second component projecting downwardly from the horizontal plane, thereby creating a void space between a bottommost cushion in the stack and the bottom panel of the container. At least one article is supported on the central portion of at least one of the cushions in the stack, and a final cushion is assembled in the container on top of the stack. The final cushion is oriented so that its cushioning members project at angles which are oblique to the central portion of the cushion and which have a first component extending parallel to the horizontal plane and a second component projecting upwardly from the horizontal plane so as to create a void space between the final cushion and the top panel of the container. In embodiments of this packaging assembly, an article may be supported on the central portion of each of the cushions in the series of cushions.

Still another aspect of the present invention provides a packaging assembly including a container having a sidewall, a top panel, a bottom panel and at least one side panel. An article is disposed in the container, and at least one cushion is positioned between the article and the container for supporting the article in a suspended position in the container. At least a first portion of the cushion defines at least a first resilient arch between the article and one of the panels of the container, the arch including a pair of ends contacting the panel at spaced locations and an intermediate portion spaced from the panel. A second portion of the cushion may define at least a second resilient arch between the article and another panel of the container, the second arch including a pair of ends contacting the other panel at spaced locations and an intermediate portion spaced from the other panel. In highly preferred embodiments hereof, the cushion may define at least one resilient arch between the article and each side panel of the container.

In other preferred embodiments in accordance with this aspect of the invention, the cushion may include a central portion intermediate the first and second portions. In these embodiments, the first portion, second portion and central portion together may define a resilient arch between the article and the bottom panel of the container with the first and second portions of the cushion contacting the bottom panel at spaced locations and the central portion being spaced from the bottom panel. In still more preferred embodiments, the cushion may define a pair of resilient bottom arches between the article and the bottom panel of the container, one bottom arch having an axis of curvature extending in the length direction of the container, and the other bottom arch having an axis of curvature extending in the width direction of the container.

The packaging assembly also may include another cushion positioned between the article and the container. The other cushion preferably defines at least one resilient arch between the article and each side panel of the container. The other cushion also may define one, and preferably two, resilient top arches between the article and the top panel of the container. Where two top arches are defined, one may have an axis of curvature extending in the length direction of the container, and the other may have an axis of curvature extending in the width direction of the container. In highly preferred embodiments hereof, the two cushions together define another resilient arch between the article and each of the side panels of the container. These last resilient arches have axes of curvature extending in either the length or the width direction of the container.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figures 1, 2:
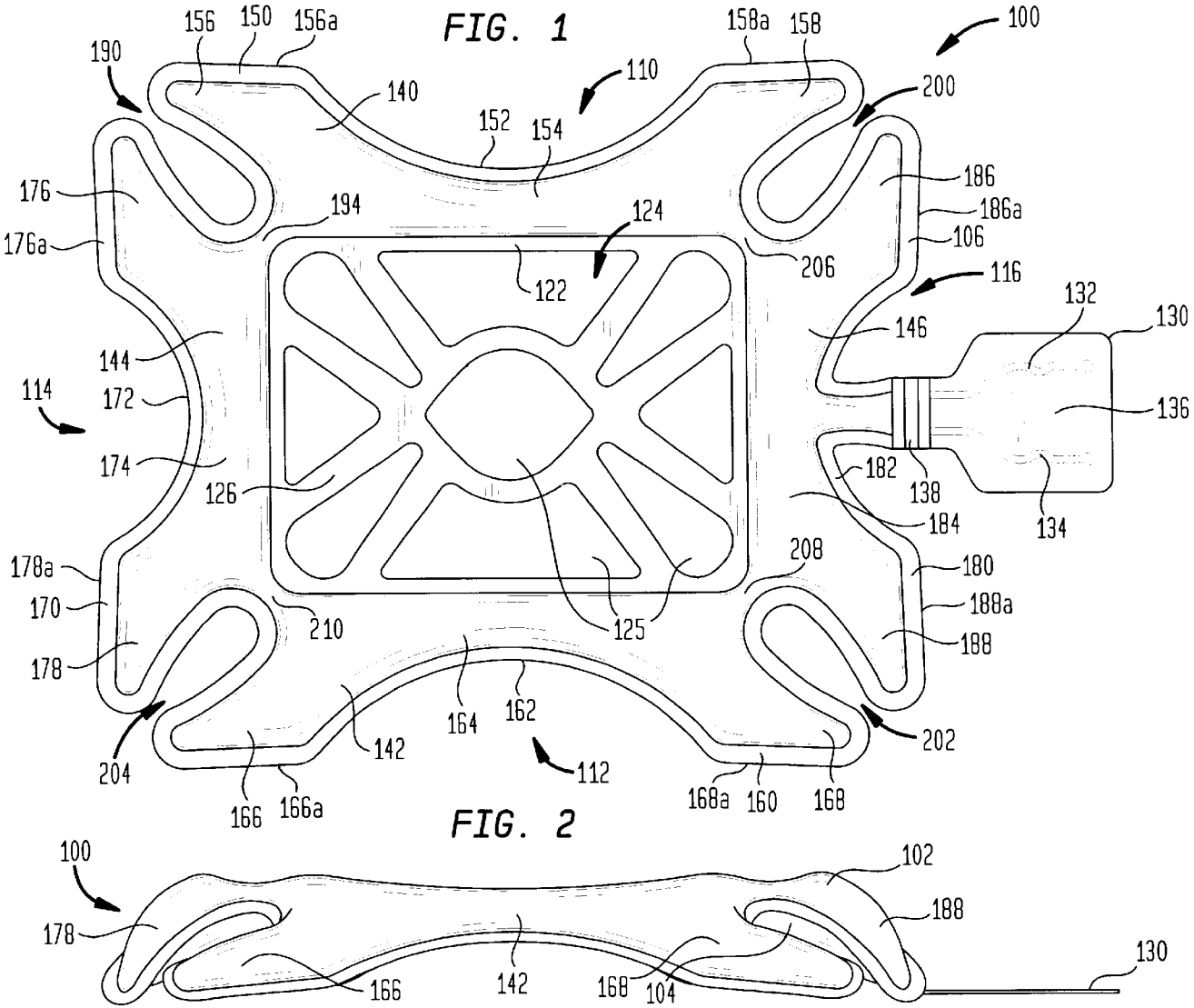
FIG. 1 is a top plan view of a packaging cushion in accordance with one embodiment of the present invention.
FIG. 2 is a side elevational view of the packaging cushion of FIG. 1.
Figure 3:
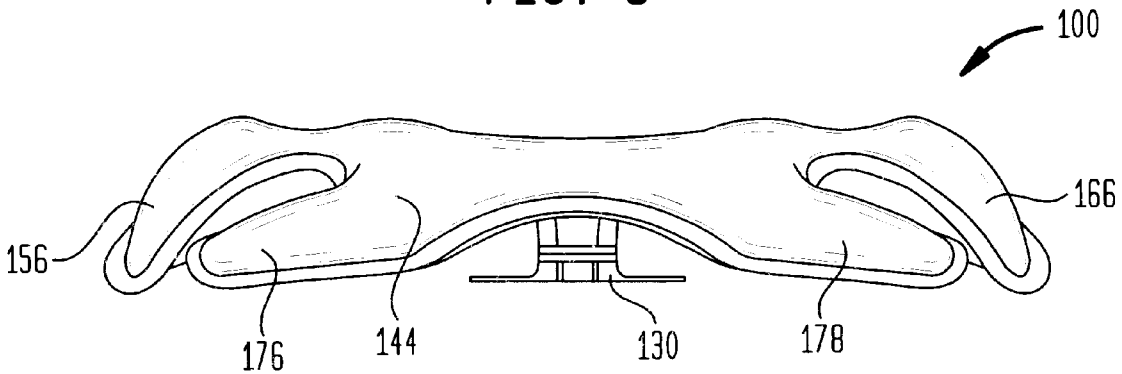
FIG. 3 is an end elevational view of the packaging cushion of FIG. 1.

Referring to the figures, a packaging cushion 100 in accordance with one embodiment of the present invention is shown in FIGS. 1–3. Packaging cushion 100 may be formed from two sheets of thermoplastic material 102 and 104 sealed along predetermined sealing lines to define a plurality of chambers having a desired configuration which are then inflated with air or another fill medium. Sheets 102 and 104 may be formed from any number of commercially available air impervious materials, such as mono- or multi-layer thermoplastic polymer films, including films comprised of polyethylene, polyurethane, or poly (ethylene-vinyl acetate). The thermoplastic sheets should be sufficiently flexible as to form smoothly curved surfaces upon inflation and, at the same time, sufficiently robust that they will not be pierced by the packaged article during shipment.

To form cushion 100, sheets 102 and 104 are juxtaposed over one another and then sealed together in the region of their peripheral edges along weld line 106. The sealing may be performed by conventional techniques, for example, heat sealing. Cushion 100 has an outer profile which substantially describes a rectangle having sides 110 and 112 and ends 114 and 116. Sheets 102 and 104 are also sealed together along weld line 122 to define a window 124 having a shape which corresponds generally to the shape of the article A to be packaged therein. Window 124 may be formed with a square or rectangular configuration to accommodate an article, such as a computer hard drive, having a square or rectangular shape. However, window 124 is not limited to these shapes, and may be formed with round, oval, hexagonal or other shapes as desired. Sheets 102 and 104 in window 124 are sealed off from the remainder of cushion 100 by weld line 122, and therefore do not inflate as the cushion is inflated. Once window 124 has been formed, a series of apertures 125 may be formed in this uninflated region to define a web or basket 126 for supporting article A in window 124. The presence of apertures 125 renders the sheet material forming web 126 more yielding, thereby improving the shock absorbing and protective performance of cushion 100.

Cushion 100 may be provided with a single inflation valve 130 positioned at any one of a number of locations along the peripheral edge of the cushion. Inflation valve 130 may be formed from portions of thermoplastic sheets 102 and 104 projecting outwardly from weld line 106 and sealed together along spaced weld lines 132 and 134 so as to form an access port 136 for an inflation nozzle. After cushion 100 has been inflated, access port 136 may be closed by clamping or may be hermetically sealed, as at weld line 138, using conventional techniques such as heat sealing, thereby sealing cushion 100 in the inflated condition. Alternatively, valve 130 may be one of the self-sealing types of valves which are known in the art.

As it exits the manufacturing process, cushion 100 is in a flat, deflated state. In this condition, cushion 100 occupies a small volume, so that a plurality of the cushions may be shipped to an end user and stored in a minimum of space. The end user may then inflate cushion 100 with a filler medium in a known fashion, and seal passage 136 to maintain the cushion in the inflated state. Although a preferred filler medium for inflating cushion 100 is air, any gas providing particularly desirable properties may be used. Furthermore, rather than air or another gas, cushion 100 may be filled with a liquid, gel, expandable foam or other substance in order to take advantage of the cushioning and shock dampening properties of these materials. The greater weight of these filler materials, however, makes them less desirable for shipping purposes.

As cushion 100 is inflated, sheets 102 and 104 bulge away from one another until the cushion has achieved its inflated shape. Continued inflation will not significantly alter the shape, but may impact the flexibility and overall shock-absorbing properties of the cushion. Upon inflation, cushion 100 forms sidewalls 140 and 142 on opposite sides of window 124, and end walls 144 and 146 on opposite ends of window 124.

The portion of weld line 106 defining sidewall 140 is indicated generally at 150. Weld line 150 is spaced from weld line 122 and includes a center portion 152 in the form of a smooth arch defining an elongated intermediate portion 154 of sidewall 140 and a pair of legs 156 and 158 projecting from the opposite ends of intermediate portion 154. The ends 156*a* and 158*a*, respectively, of legs 156 and 158 may be substantially aligned with one another and generally parallel to the sides of window 124 to facilitate the support of cushion 100 in an outer box, as described more fully below.

Sidewall 142 is substantially a mirror image of sidewall 140. That is, sidewall 142 includes a weld line 160 spaced from weld line 122. Weld line 160 has a center portion 162 in the form of a smooth arch which defines an elongated intermediate portion 164 of the sidewall, and a pair of legs 166 and 168 projecting from the opposite ends of intermediate portion 164. Legs 166 and 168 may terminate in ends 166*a* and 168*a,* respectively, which are aligned with one another and generally parallel to the side of window 124. Weld lines 150 and 160 may be spaced from weld line 122 by about the same amount so that sidewalls 140 and 142 have about the same diameter.

End walls 144 and 146 have structures which are similar to the structures of sidewalls 140 and 142. Thus, end wall 144 includes a weld line 170 spaced from weld line 122 and having a center portion 172 in the form of a smooth arch defining an intermediate end wall portion 174 and a pair of end legs 176 and 178 projecting from the opposite ends of intermediate portion 174. Similarly, end wall 146 includes a weld line 180 spaced from weld line 122 and having a center portion 182 in the form of a smooth arch defining an intermediate portion 184 of the end wall and a pair of end legs 186 and 188 projecting from the opposite ends of intermediate portion 184. The ends 176*a* and 178*a* of legs 176 and 178 may be aligned with one another, and the ends 186*a* and 188*a* of legs 186 and 188 may be aligned with one another. Moreover, the ends of all of these legs may be generally parallel to the ends of window 124. The diameters of end walls 144 and 146 may be about the same as one another and may be about the same as the diameters of sidewalls 140 and 142.

At each corner of cushion 100, weld line 106 defines an inwardly projecting recess or gap separating sidewalls 140 and 142 from end walls 144 and 146. More particularly, weld line 106 defines a gap 190 separating sidewall 140 from end wall 144. Weld line 106 extends a major portion of the distance toward window 124 so that, at the apex of gap 190, weld line 106 is spaced from weld line 122 by only a small amount which defines a narrow passageway 194 interconnecting sidewall 140 with end wall 144. Passageway 194 has a cross-sectional size which is much less than the cross-sectional size of the intermediate portions 154 and 164 of sidewalls 140 and 142, respectively, and the intermediate portions 174 and 184 of end walls 144 and 146, respectively. Similar gaps 200, 202 and 204 at the other corners of cushion 100 define passageways 206, 208 and 210, respectively, which interconnect the sidewalls with their adjacent end walls to form a continuous ring extending generally in a horizontal plane around window 124. As used herein, the term "horizontal plane" refers to the plane defined by the length and width directions of window 124 (i.e., the plane of the page in FIG. 1). The presence of gaps 190, 200, 202 and 204 enables the sidewalls and end walls to move substantially independently of one another, while the presence of passageways 194, 206, 208 and 210 enables the sidewalls and the end walls to be inflated together using a single inflation valve 130.

Upon inflation of cushion 100, sidewalls 140 and 142 and end walls 144 and 146 rotate to orientations oblique to the plane of window 124 (i.e., the horizontal plane), as illustrated in FIGS. 2 and 3. That is, the sidewalls and end walls project in directions having a component parallel to the horizontal plane and a component perpendicular to the horizontal plane. While not wishing to be held to any particular theory, it is believed that this rotation results from the substantial difference in cross-sectional size between the sidewalls and end walls, on the one hand, and the passageways interconnecting same, on the other hand, as well as the tension in sheets 102 and 104 when inflated. The sidewalls and end walls may rotate from the horizontal plane by about the same amount. Preferably, the sidewalls and end walls assume orientations which form angles of between about 30° and about 60° relative to the horizontal plane; more preferably between about 40° and about 50° relative to the horizontal plane; and most preferably about 45° relative to the horizontal plane. As described below, the rotation of the sidewalls and end walls provides cushion 100 with shock-absorbing properties and enables the cushion to provide improved protection over prior art devices.

Once inflated, a pair of substantially identical cushions 100 and 199 may be used to hold an article A in a suspended position within an outer container. As used herein, the term "suspended position" refers to positions in which the article A or other articles are supported in window 124 so that they are spaced from at least the top and bottom of the outer container by void spaces other than the interiors of the cushions. Preferably, articles packaged in suspended positions are spaced by void spaces in all directions from the outer container.

Figure 4:
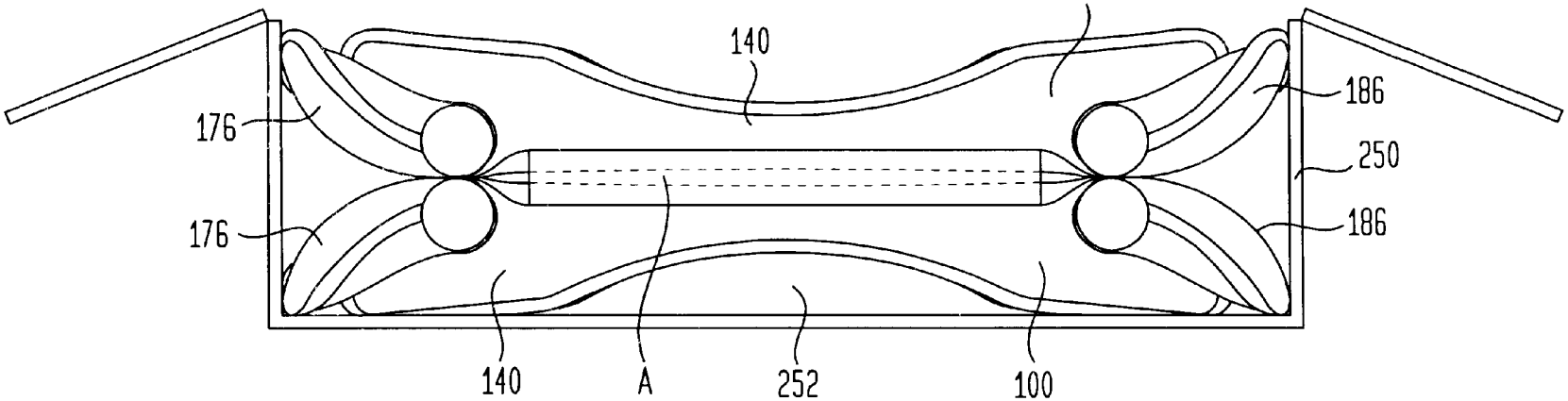
FIG. 4 is a cross-sectional view showing a pair of the packaging cushions of FIG. 1 used to package an article in an outer container.

FIG. 4 is a cross-sectional view showing the use of two cushions 100 and 199 to support an article A in a suspended position within an outer receptacle, such as a conventional or more highly reinforced corrugated fiberboard box 250. A first cushion 100 is placed in the bottom of box 250 with its sidewalls 140 and 142 and end walls 144 and 146 projecting downwardly and outwardly toward the bottom and sides of the box. Cushion 100 and box 250 are sized relative to one another so that, when cushion 100 is placed in box 250, the ends of legs 156, 158, 166 and 168 abut the edges of the box where the box sidewalls meet the box bottom, and the ends of legs 176, 178, 186 and 188 abut the edges of the box where the box end walls meet the box bottom. In this arrangement, web 126 of window 124 is spaced from the bottom of the box, creating a void space 252 therebetween. Similarly, void spaces are created between intermediate portions 154 and 164 of sidewalls 140 and 142 and the sides of the box opposed thereto, and between intermediate portions 174 and 184 of end walls 144 and 146 and the sides of the box opposed thereto. An article A is then placed on web 126. Window 124 may be sized so that article A occupies substantially the entire surface area of web 126, leaving little room for lateral movement of the article within the window. Where an article is substantially smaller than the surface area of the window, however, a padding material, fill material or other dunnage may be inserted in the window around the article or wrapped around the article to occupy a substantial portion of the remaining surface area.

With article A in assembled position, a second cushion 199 may be placed over cushion 100 so that the window 124 in cushion 199 is positioned over the article and the sidewalls and end walls of cushion 199 project upwardly and outwardly toward the top and sides of the box, thereby defining void spaces between the window 124 in cushion 199 and the top of the box, and between the intermediate portions of the sidewalls and end walls of the cushion and the sides of the box opposed thereto. Cushion 199 may be placed in an orientation with its sidewalls and end walls projecting upwardly simply by rotating a cushion having its sidewalls and end walls projecting downwardly 180° about its longitudinal axis. Alternatively, a cushion having its sidewalls and end walls projecting downwardly may be inverted simply by rotating sidewalls 140 and 142 or end walls 144 and 146 along the portions of weld line 122 adjacent thereto. Preferably, box 250 has an overall height such that, with cushion 199 in its assembled position, the ends of its legs 156, 158, 166 and 168 abut the edges of the box where the box sidewalls meet the top of the box, and the ends of its legs 176, 178, 186 and 188 abut the edges of the box where the box end walls meet the box top. In other words, when cushions 100 and 199 and article A are assembled in box 250, the assembly desirably spans the box in the length, width and height dimensions. Once cushion 199 has been assembled over article A, box 250 may be closed and sealed in a known fashion and shipped.

Depending upon the thickness of article A, the sidewalls and end walls of the second cushion 199 assembled in box 250 may rest upon or be spaced from the sidewalls and end walls of the first cushion 100. Where article A is relatively thick, web 126 of cushion 199 may rest upon article A such that the sidewalls and end walls of cushion 199 will be spaced from the sidewalls and end walls of cushion 100. In those circumstances where article A is relatively thin such that the sidewalls and end walls of the second cushion 199 rest upon the sidewalls and end walls of the first cushion 100, a void space may remain between the article A and the web 126 of the second cushion 199. This void space may be filled with a padding material, fill material or conventional dunnage to minimize the free play of article A between the webs.

In an alternative approach to minimize the free play of article A between the cushions, the apertures 125 in the web of cushion 100 may be arranged so that the corners or other portions of the article may be inserted into the apertures, whereupon the article will be held against the web. In a variant of this arrangement, a pair of parallel slits may form a central strip in the length, width or a diagonal direction in the web 126 of cushion 100, and article A may be inserted and held in place between the strip and the remainder of the web. In a still further arrangement, web 126 may be formed without apertures 125, and a single slit may be formed in one of the sheet materials 102 and 104 forming web 126, but not through the other sheet material. The slit would then provide access to the pouch formed in web 126 between sheet materials 102 and 104. Article A may be inserted through the slit and held in the pouch during shipping. It will be appreciated that various combinations of the foregoing techniques may also be devised to hold article A securely in place and minimize its free play.

Figure 5:
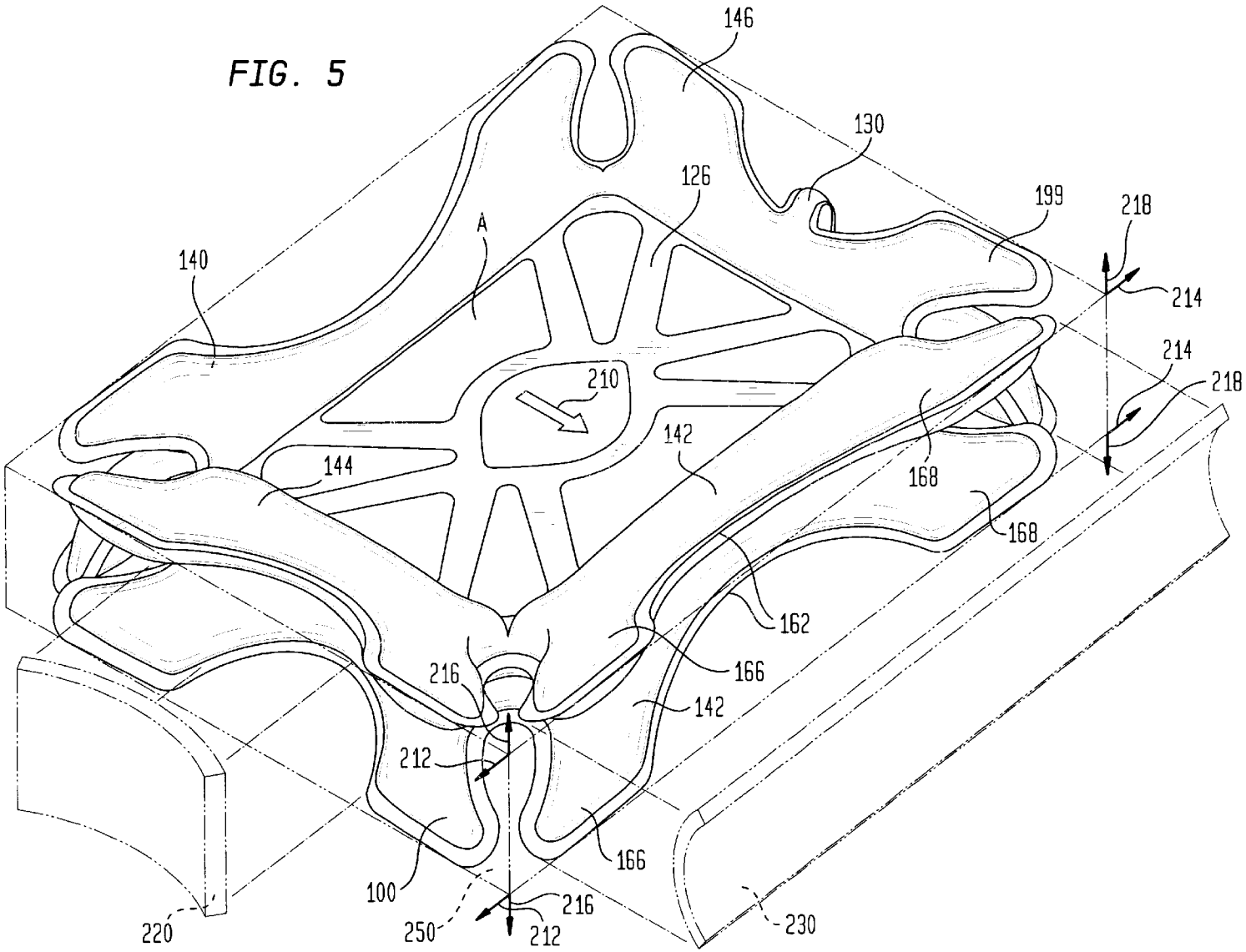
FIG. 5 is a perspective view showing a pair of the packaging cushions of FIG. 1 holding an article within an outer container, with arrows showing the direction of force extended by the cushion with respect to one sidewall of the container.

The packaging described above amply protects article A from damage during shipping. With article A nested between cushions 100 and 199, lateral or side-to-side protection is provided by the sidewalls 140 and 142 and end walls 144 and 146 of the cushions which keep article A separated from the sides and ends of box 250, and top-to-bottom or vertical protection is provided by webs 126 which suspend article A at spaced distances from the top and bottom of the box. Furthermore, the arrangement of cushions 100 and 199 within box 250 produces flexible arched structures in all of the orthogonal directions of the box, cushioning article A against an impact force in any direction. For example, referring to FIG. 5, in a side impact on the box, article A will have an inertia in the direction of arrow 210. As a result of this inertia, the arches defined by center portions 162 of cushions 100 and 199 will attempt to flatten out. (Although a schematic representation of these arches is not illustrated, FIG. 5 shows a schematic representation in phantom lines of a similar arch 220 formed by the center portions at the ends of the cushions). More particularly, the legs 166 and 168 in each cushion will be driven away from one another in the directions of arrows 212 and 214 toward the end walls of box 250. Similarly, the arch 230 defined by the combined sidewalls 142 of these two cushions (and represented schematically by phantom lines in FIG. 5) will attempt to flatten out. That is, legs 166 and 168 of cushion 100 will be driven away from legs 166 and 168 of cushion 199 in the directions of arrows 216 and 218, forcing these legs against the top and bottom panels of the box. Since legs 166 and 168 of both cushions are constrained against movement, the arches do not flatten out, but rather produce a resistive force which dampens the impact force which reaches article A. The same types of flexible arches are formed where cushions 100 and 199 abut the opposite side of box 250, as well as between the end walls of cushions 100 and 199 and the ends of the box. In addition to the resistive forces produced by the flexible arches, further force dampening is provided by the partial compression of the sidewalls and/or end walls of the cushion.

The flexible arch concept also protects article A from impacts in the top-to-bottom or vertical direction. For example, as box 250 is dropped, article A will have an inertia driving the article toward the bottom of the box. This force ordinarily would cause the arches defined in the length direction of cushion 100 between sidewalls 140 and 142 and in the width direction of cushion 100 between end walls 144 and 146 to flatten out; i.e., by driving the legs 156 and 158 of sidewall 140 away from the legs 166 and 168 of sidewall 142, and the legs 176 and 178 of end wall 144 away from the legs 186 and 188 of end wall 146. However, because the sidewall legs and end wall legs are constrained by the sides and ends of box 250, respectively, the arches do not flatten out, but rather may flex slightly to absorb a portion of the impact force. Further portions of the impact force may be absorbed by the partial compression of the sidewall legs and end wall legs, and by the stretching of the web 126 supporting article A.

It will be appreciated that numerous modifications may be made to cushion 100 while still providing the protective function of the invention. In one such modification, cushion 100 may be formed with an outer profile which is not rectangular, but which is round, triangular, trapezoidal or any other shape, preferably conforming to the shape of the outer container in which cushion 100 is to be used. In another modification, cushion 100 may be formed with end walls 144 and 146, but without sidewalls 140 and 142. In such embodiments, cushion 100 may have a width which corresponds to the width of the outer container in which it is used, or it may have a smaller width, with dunnage, foam sheets, inflated pillows or other packaging structures placed between the sides of cushion 100 and the outer container. The arrangement within box 250 of a pair of cushions 100 and 199 having such a configuration would produce flexible arched structures between the packaged article and the top, bottom and ends of the box, but not between the article and the sides of the box where the potential for damage in that particular application may be significantly less. In a similar vein, cushion 100 may be formed with sidewalls 140 and 142, but without end walls 144 and 146. Cushions having such a configuration may be used in the same fashion as cushions having end walls, but no sidewalls.

For certain applications, it may be desirable to use a single cushion 100 within an outer box 250, with the article A disposed on the web 126 of the cushion. The remainder of the void space between the article and the top of box 250 may then be filled with paper, foam pellets, cotton batting, expanded or molded foams, and other dunnage materials.

Additionally, although FIG. 1 shows cushion 100 as being substantially symmetrical, that need not be the case. More particularly, the dimensions of sidewalls 140 and 142 between weld line 106 and window 124 may be different from the dimensions of end walls 144 and 146 between weld line 106 and window 124. Furthermore, the dimensions of sidewall 140 between weld line 106 and window 124 need not be the same as the dimensions of sidewall 142 between weld line 106 and window 124, and the dimensions of end wall 144 between weld line 106 and window 124 need not be the same as the dimensions of end wall 146 between weld line 106 and window 124. In other words, the dimensions of the various portions of cushion 100 may be tailored to meet the needs of a specific application.

Figure 6:
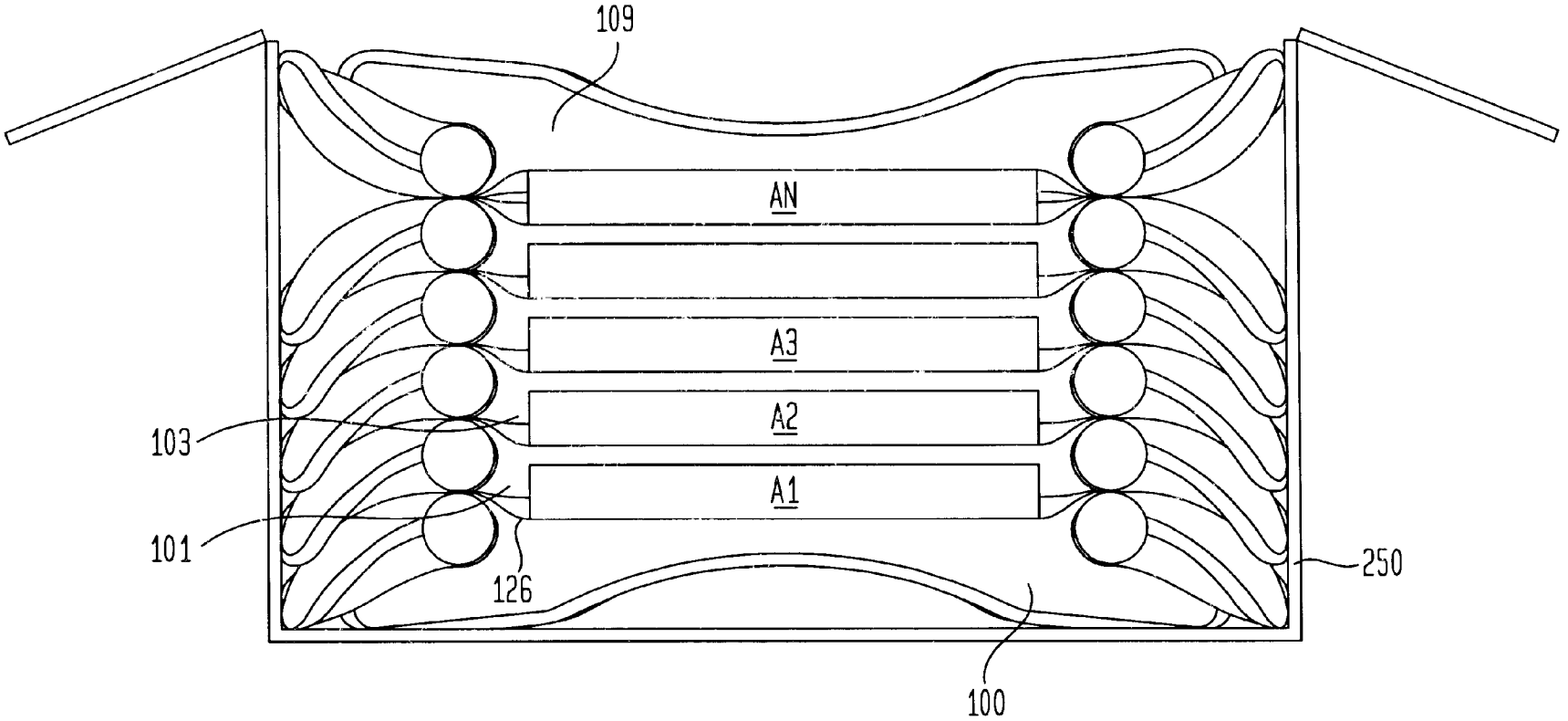
FIG. 6 is a cross-sectional view showing a plurality of the packaging cushions of FIG. 1 used to package plural articles in layers in an outer container.

In another arrangement, multiple cushions similar to cushion 100 may be used to ship a plurality of articles A in stacked arrangement within an outer box 250. In such arrangement, shown in FIG. 6, the first cushion 100 is placed in box 250 in the same manner as described above, i.e., with its sidewalls 140 and 142 and end walls 144 and 146 projecting toward the bottom of the box. A first article A1 may then be placed on the web 126 of cushion 100, and a second cushion 101 may be placed over the article, cushion 101 being oriented with its sidewalls and end walls also facing downwardly. Preferably, the sidewalls and end walls of cushion 101 rest upon the sidewalls and end walls of cushion 100, such that a void space may remain between article A1 and the web 126 of overlying cushion 101. Any of the techniques described above in connection with the packaging of article A may be used to prevent the free play of article A1 between the webs. A second article A2 may then be placed on the web of cushion 101, and a third cushion 103 may be assembled thereover, again with its sidewalls and end walls projecting toward the bottom of the box. This procedure may be repeated until the desired number of articles have been stacked on top of one another. When the last article AN has been assembled in the box, a final cushion 109 may be placed on top of the stack, cushion 109 being oriented with its sidewalls and end walls projecting toward the top of the box. Subsequently, the box may be closed and sealed in a conventional method and shipped. Rather than placing an article on the web 126 of each cushion, it will be appreciated that, depending upon the circumstances, an article may be placed on the web in every other cushion, every third cushion, or on the web of only a single cushion in the stack.

A second embodiment of a packaging cushion 300 in accordance with the present invention is shown in FIGS. 7–10. Packaging cushion 300 includes a plurality of inflatable chambers 312 interconnected by inflatable passageways 314 to form a continuous loop or ring which may be wrapped around the sides of article A to support article A in a suspended position within an outer container. Cushion 300 is similar to and is made by methods similar to certain embodiments of cushions disclosed in U.S. application Ser. No. 09/236,793, the disclosure of which is hereby incorporated by reference herein.

Figure 7:
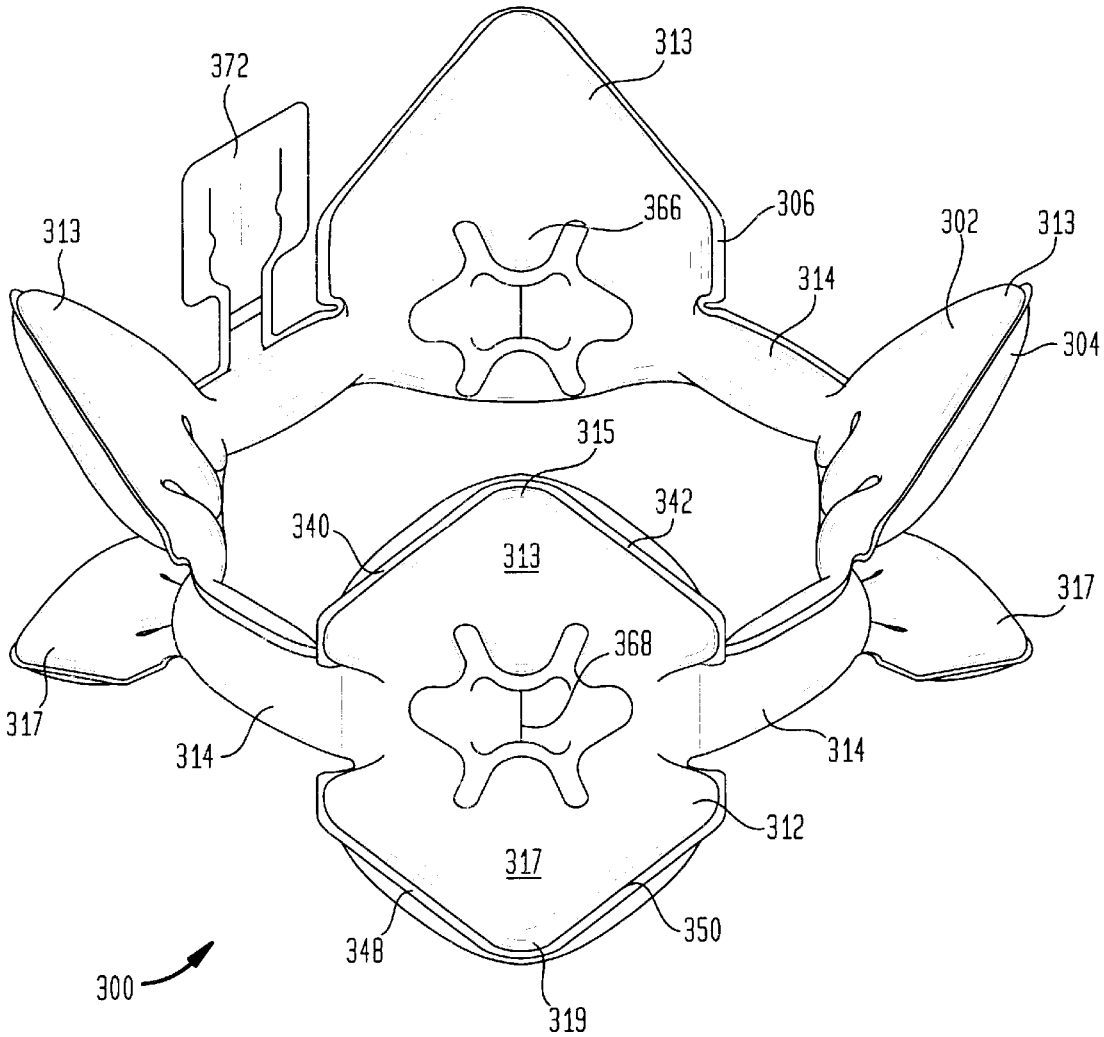
FIG. 7 is a perspective view of a packaging cushion in accordance with a second embodiment of the present invention.
Figure 8:
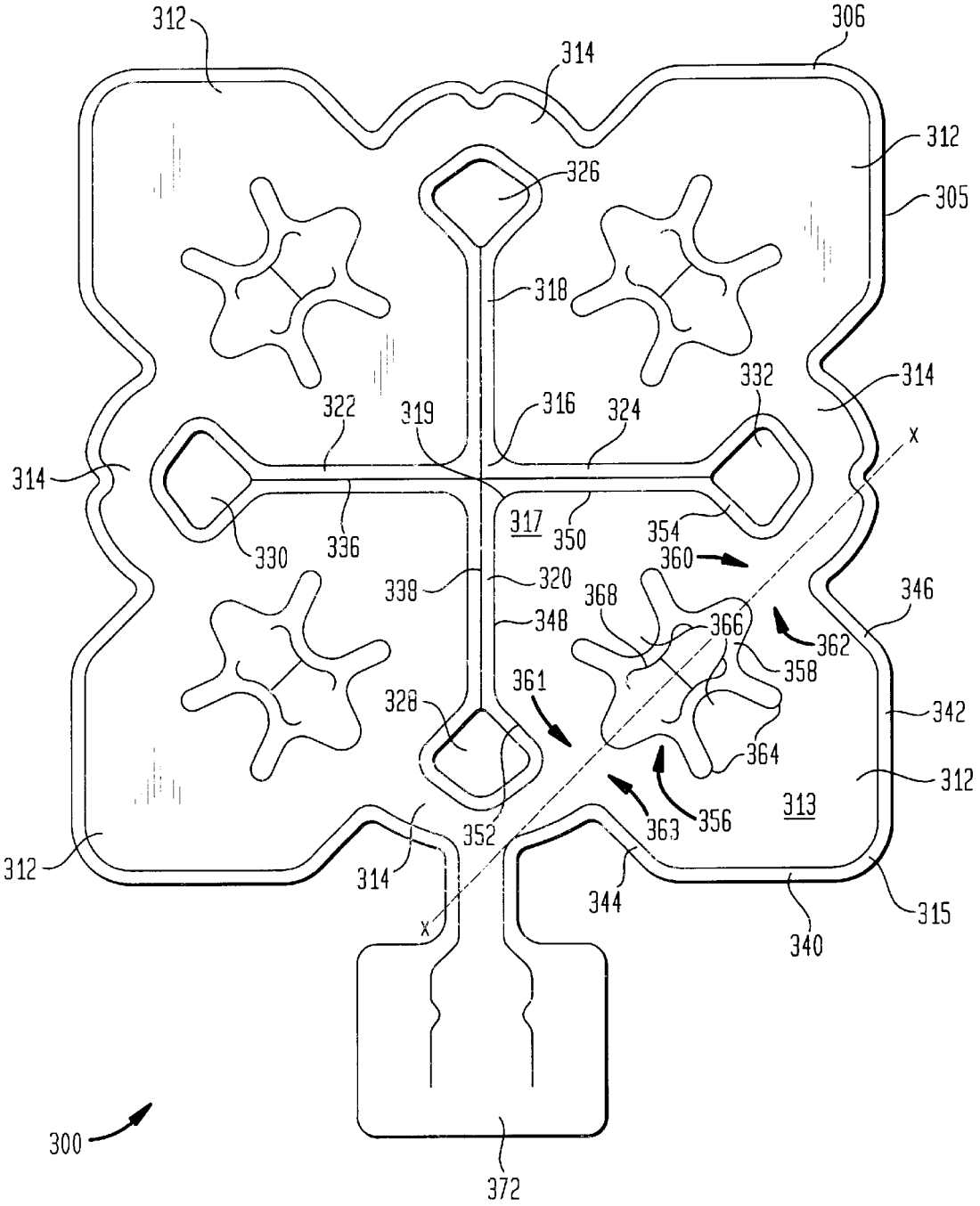
FIG. 8 is a top plan view of the packaging cushion of FIG. 7 in its deflated state.

A blank for forming packaging cushion 300 is illustrated in the deflated condition in FIG. 8. Packaging cushion 300 may be formed from two sheets of thermoplastic material 302 and 304 (FIG. 7), which may be the same thermoplastic materials as described above in connection with cushion 100. Sheets 302 and 304 are juxtaposed over one another and sealed together in the region of their external peripheral edge 305 along weld line 306 using conventional techniques, such as, for example, heat sealing. Sheets 302 and 304 also may be sealed together in interior welded regions to divide cushion 300 into chambers 312 and interconnecting passageways 314. These interior welded regions may include a central region 316, and weld lines 318, 320, 322 and 324 extending outwardly in orthogonal directions from central region 316. Enlarged sealed areas 326, 328, 330 and 332 may be formed at the ends of weld lines 318, 320, 322 and 324, respectively, to define passageways 314. Once the interior welded regions have been formed, slits 336 and 338 may be formed through sheets 302 and 304 so that chambers 312 may be moved relative to one another. Furthermore, excess portions of sheets 302 and 304 may be removed from sealed areas 326, 328, 330 and 332 to increase the flexibility of passageways 314 and facilitate the relative movement of chambers 312.

Each passageway 314 interconnects two adjacent chambers 312 so that there is flow communication between the chambers. As described below, passageways 314 may vary in length depending upon the dimensions of the article A to be packaged, thus varying the positioning of the chambers 312 relative to one another.

Each of chambers 312 may be formed with a generally hexagonal shape including sides 340 and 342 and side portions 344 and 346 formed by weld line 306 and defining a first portion or leg 313 of chamber 312 having an apex 315, and sides 348 and 350 and side portions 352 and 354 formed by weld lines 320 and 324, respectively, and defining a second portion or leg 317 of chamber 312 having an apex 319. The other chambers are similarly formed. Chambers 312 are not limited to hexagonal shapes, however, and may be formed with other shapes dictated by the size, shape, weight and other characteristics of the article to be packaged and the shape of the outer container, as well as by manufacturing considerations.

Sheets 302 and 304 may be further sealed together to define a sealed region 356 generally in the center of each chamber 312. Each sealed region 356 may have an elongated central portion 358 extending along an axis X—X defined between adjacent passageways 314. Central portion 358 defines a first narrow passageway 360 between an end of central portion 358 and sealed area 332, and a second narrow passageway 362 between the end of central portion 358 and weld line 306. Similar narrow passageways 361 and 363 are formed between the opposite end of central portion 358 and sealed area 328 and weld line 306, respectively. Optionally, a series of sealed fingers 364 may project outwardly from either side of central portion 358, defining an inflatable tongue 366 between the fingers on each side of the central portion, the purpose of which will be described below. Once sealed regions 356 have been formed, sheets 302 and 304 therein may be slit in a generally H-shaped pattern, as at 368, so as to define an opening 370 (FIG. 10) through the center of each chamber 312. As explained below, openings 370 are intended to receive the corners of the article being packaged so as to support the article at its corners during shipping.

Cushion 300 may include an inflation valve 372 positioned at any one of a number of locations along the external peripheral edge 305 thereof. Optionally, inflation valve 372 may extend from a position in the interior welded regions. Inflation valve 372 may be a conventional self-sealing valve or may be the same type of heat-sealed or clamped access port formed in substantially the same manner as described above in connection with inflation valve 130. Since each chamber 312 is interconnected with its adjacent chambers through passageways 314, a single inflation valve 372 would suffice to inflate the entire cushion 300.

As it exits the manufacturing process, cushion 300 is in the flat, deflated state illustrated in FIG. 8. In this condition, cushion 300 occupies a small volume, so that a plurality of the cushions may be shipped to an end user and stored in a minimum of space. The end user may then inflate cushion 300 with a filler medium in a known fashion, and seal inflation valve 372 to maintain the cushion in the inflated state. Any liquid, gas, gel, expandable foam or other substance may be used to fill cushion 300, with air being most preferred.

As cushion 300 is inflated, sheets 302 and 304 bulge away from one another until the cushion has achieved its inflated shape. Continued inflation will not significantly alter the shape of cushion 300, but may impact the flexibility and overall shock absorbing properties of the cushion. Thus, overfilling may result in a rigid cushion 300 that fails to conform satisfactorily to the size and shape of the packaged article, and that may rupture as a result of a violent physical force or shock associated with transport.

Once inflated, cushion 300 retains the general shape illustrated in FIG. 8, with chambers 312 oriented generally edge-to-edge and passageways 314 all lying in substantially the same plane. However, inflation causes legs 313 and 317 of chambers 312 to fold toward one another along passageways 360–363 and sealed region 356. While not wishing to be held to any particular theory, it is believed that this folding action results from the narrow size of passageways 360–363 as well as the tension in sheets 302 and 304 when inflated. In that regard, passageways 360–363 must be sufficiently narrow that leg 313 of chamber 312 may fold toward leg 317 of the chamber along these narrow passageways, yet sufficiently large that all of the chambers in cushion 300 inflate relatively quickly. If passageways 360–363 are too wide, legs 313 and 317 of chambers 312 will not fold toward one another. On the other hand, if these passageways are too narrow, they will restrict the flow of inflation medium into the chambers and hamper inflation.

After inflation, chambers 312 of cushion 300 may be rotated along their respective axes X—X to the ring-like configuration shown in FIG. 7. In this configuration, cushion 300 may be assembled around an article A so as to support the article in a suspended condition. The following will describe the assembly of cushion 300 around an article A after the cushion has been inflated. However, it will be appreciated by those skilled in the art that article A also may be assembled in the cushion either before or during inflation.

In one technique for assembling an inflated cushion 300 over article A, the article is oriented so that each corner R of the article is aligned with one chamber 312, and more particularly, with the opening 370 therein. A first corner of article A may be inserted in one opening 370, and cushion 300 then may be stretched around the article to assemble each other corner of the article in a corresponding one of openings 370. Assembly may be accomplished by proceeding from the first corner of the article to the next adjacent corner in sequence, or by assembling the cushion over a first pair of diagonally opposed corners of the article followed by the other pair of diagonally opposed corners. The particular technique employed to assemble cushion 300 over article A is not critical, and will be determined by the size, bulk and durability of the article, as well as other factors.

Figure 9:
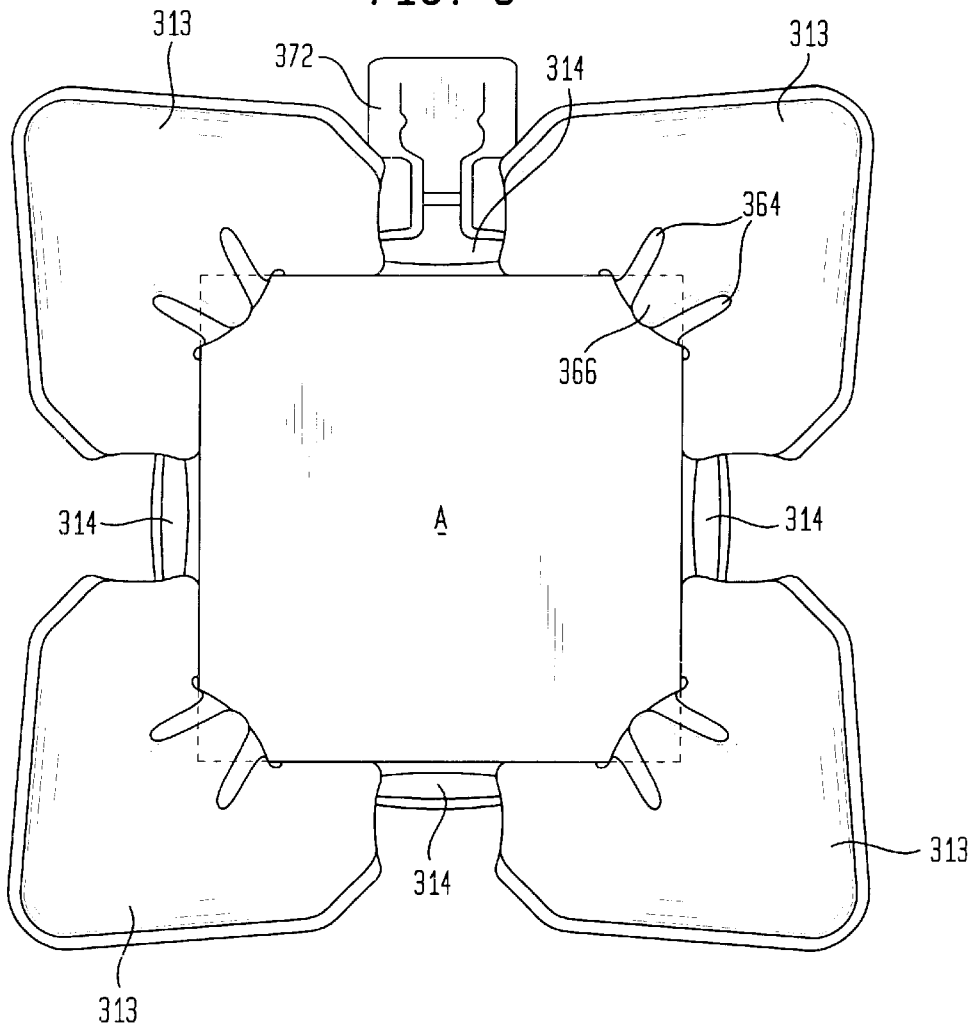
FIG. 9 is a top plan view of the packaging cushion of FIG. 7 in its inflated state surrounding an article to be packaged.
Figure 10:
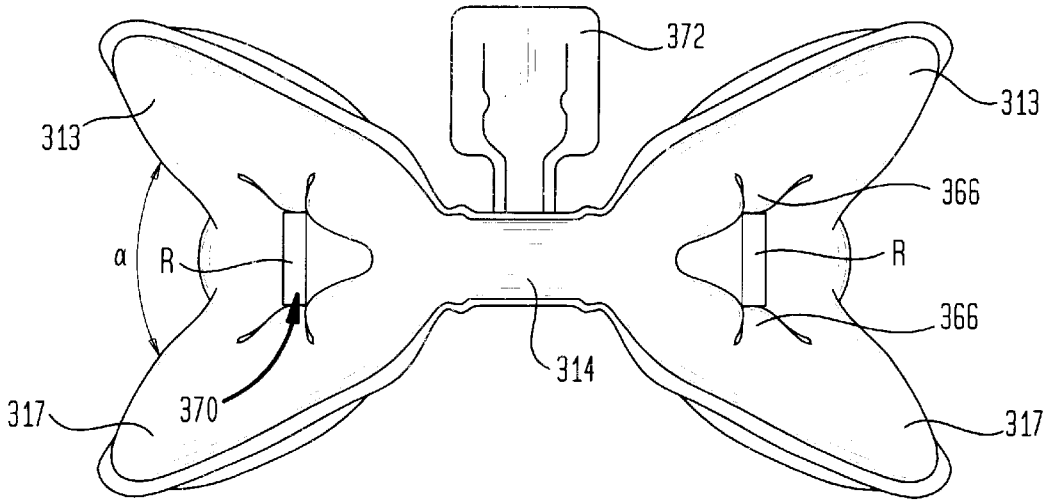
FIG. 10 is a side elevational view of the packaging cushion of FIG. 7 in its inflated state surrounding an article to be packaged.
Figure 11:
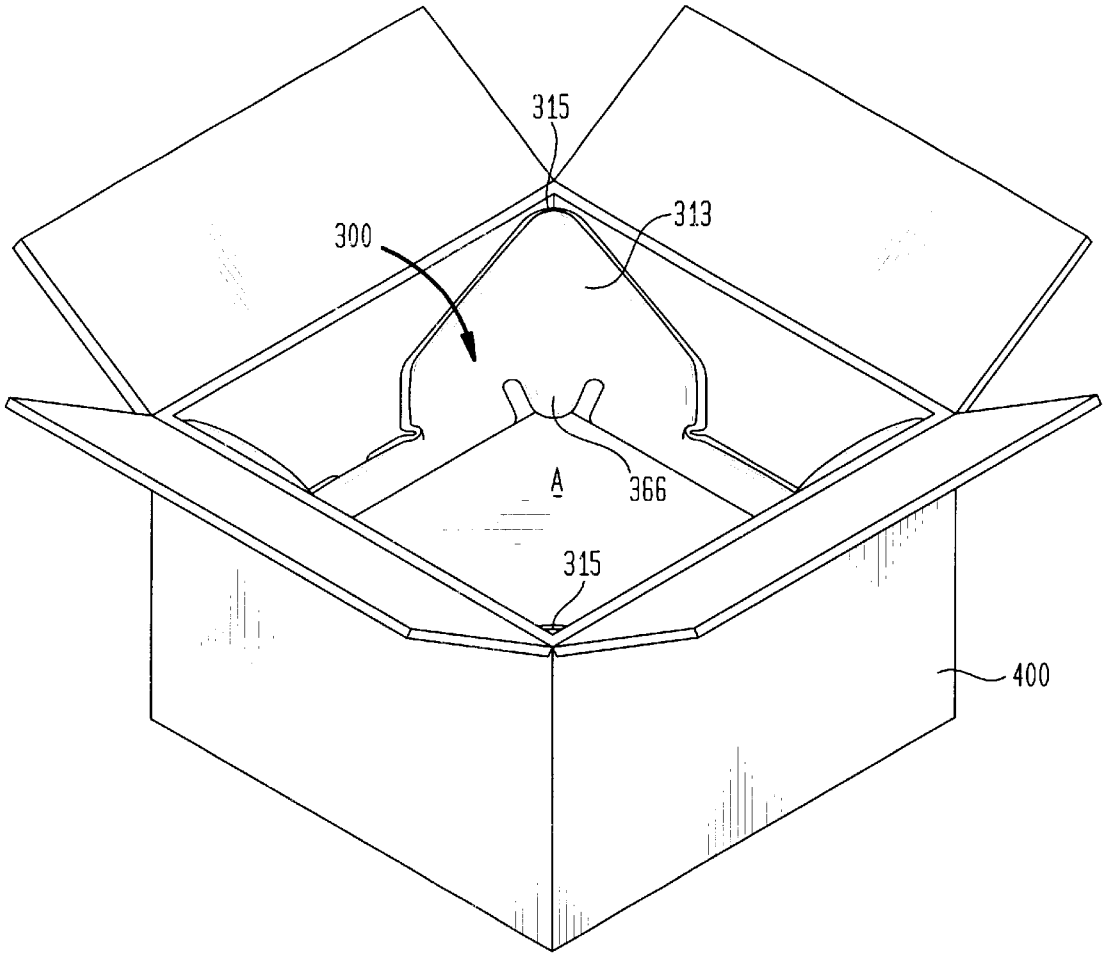
FIG. 11 is a perspective view showing the use of the packaging cushion of FIG. 7 to package an article in an outer container.

FIGS. 9 and 10 illustrate an article A after it has been assembled within cushion 300. As illustrated, each chamber 312 substantially overlies one corner R of the article, with the corner protruding through the opening 370 therein. With this particular embodiment of cushion 300, inflated tongues 366 are positioned against the upper and lower surfaces of each corner R so as to support article A with a minimum amount of surface contact and with the localized resiliency provided by these tongues. The use of tongues 366 is particularly desirable for articles that are light in weight and which therefore require the increased resiliency provided by the tongues, as well as for articles that have delicate surface features.

In order to be assembled around article A and properly support the article during shipping, it is important that the ring-like structure formed by cushion 300 be of an appropriate size relative to the peripheral size of article A. As described above, cushion 300 desirably is stretched as it is assembled over article A. In that regard, if cushion 300 is made too large so that it fits loosely around the periphery of article A, the corners of the article may become disengaged from chambers 312 and may fall through the cushion and be damaged during shipping. On the other hand, if cushion 300 is made too small relative to the peripheral size of article A, it may be difficult, if not impossible, to assemble the cushion over the article, and the article may be damaged during the assembly process. As noted above, the size of the ring defined by cushion 300 may be controlled by controlling the length of passageways 314 interconnecting chambers 312.

Since cushion 300 is stretched in order to assemble same over article A, passageways 314 are in tension when the cushion is in assembled position over the article. This tension helps to maintain chambers 312 in assembled relationship over the corners R of the article. Furthermore, the tension in passageways 314 pulls the center of each chamber 312 in opposite directions, causing a further folding of legs 313 and 317 of chambers 312 toward one another. Desirably, the dimensions of each chamber 312 and the ring size of cushion 300 relative to article A are such that, when cushion 300 is assembled around article A, legs 313 and 317 fold toward one another so as to define an angle $\alpha$ therebetween of between about 60° and about 120°. An angle a of about 90° between legs 313 and 317 is particularly preferred.

After cushion 300 has been assembled around article A, the entire assembly may be placed in an outer container, such as a conventional or more highly reinforced corrugated fiberboard box 400. When placed in box 400, the apex 319 of each bottom leg 317 preferably rests in and is constrained by a bottom corner of the box, and the apex 315 of each top leg 313 preferably rests in and is constrained by a top corner of the box. Because legs 313 and 317 of each chamber 312 are angled towards the top and bottom corners of the box, respectively, cushion 300 defines structures which act like flexible arches in the length and width directions above and below article A and which support article A in a suspended position in the interior of the box. Furthermore, the projection of legs 313 and 317 toward the side and end walls of the box defines structures which act like flexible arches on the sides of the article which extend in the length and height directions of the box, and on the ends of the article which extend in the width and height directions of the box. These structures act to keep article A spaced from the sides and ends of the box and act in the same manner as the arches described above in connection with cushions 100 and 199 to dampen shock and protect the article from damage during shipping. More particularly, lateral or side-to-side protection is provided as the chambers attempt to "open up" and to move away from one another. This movement, however, is constrained by the top, bottom and sides of the box. The resultant flexing of the chambers absorbs some of the impact force, preventing it from reaching the article. Protection in the top-to-bottom or vertical direction is provided by the flexing of the chambers as legs 313 or 317 attempt to move away from one another, but are prevented from doing so by the confinement of the box. Additional protection is provided in all directions by the partial compression of chambers 312, and in the vertical direction by the partial compression of the tongues 366 on which the corners of article A are supported.

Figure 12:
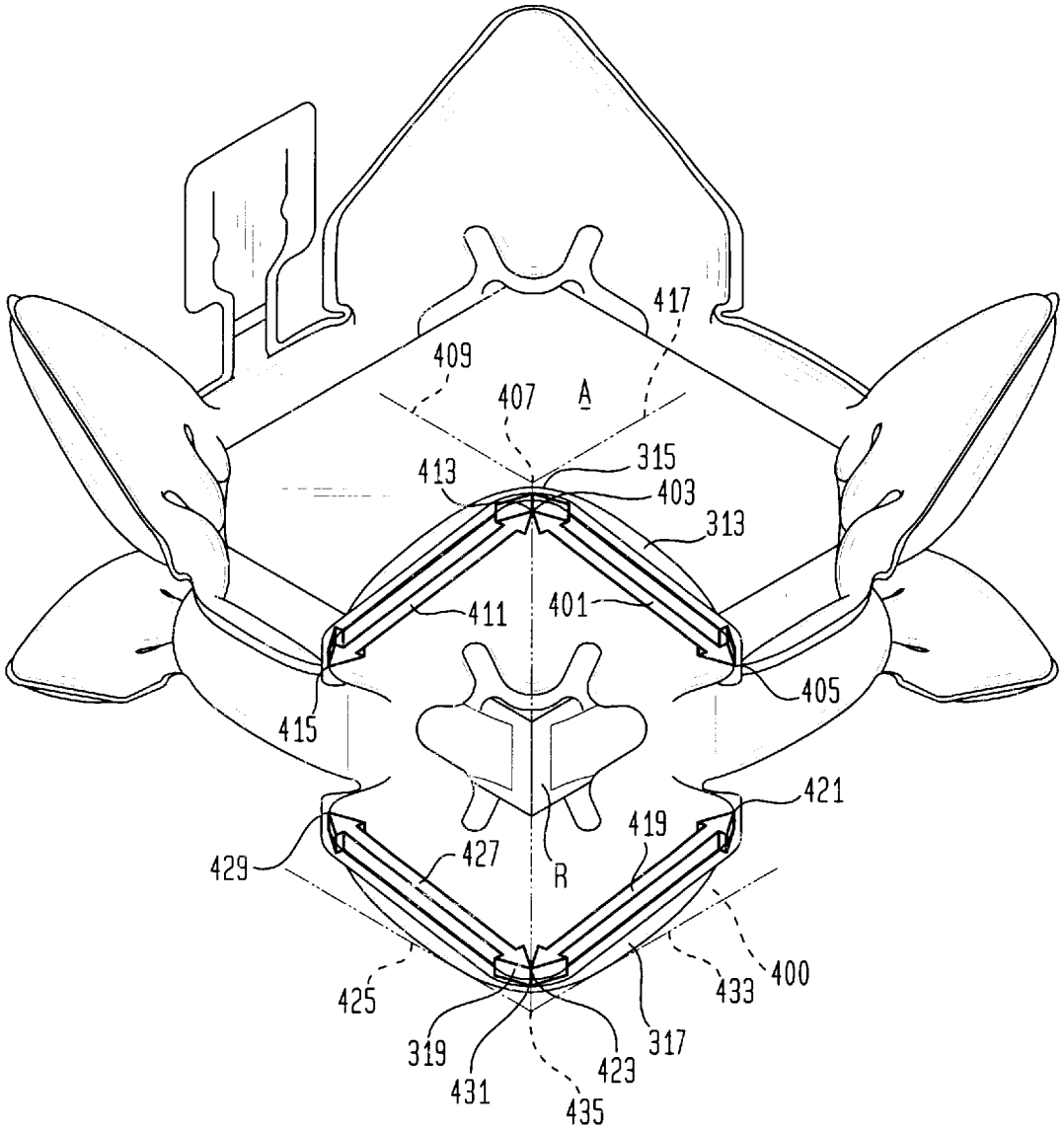
FIG. 12 is a perspective view of the packaging cushion of FIG. 7 surrounding an article to be packaged, showing a portion of the outer container in phantom, and with arrows showing the direction of force exerted by one chamber of the cushion to support a corresponding corner of the article.

Another way of analyzing the support provided by cushion 300 is to view the legs 313 and 317 in each chamber 312 as forming resilient columns of support between article A and box 400. Referring to FIG. 12, leg 313 can be viewed as providing resilient columns of support between corner R of article A and the top edges of box 400. Thus, leg 313 defines a first support column extending in the direction of arrow 401 (which is generally in the length direction of box 400) between a top end 403 and a bottom end 405. As a result of the assembly of chamber 312 over the corner R of article A, bottom end 405 is fixed relative to the top surface of article A. Also, as a result of the resilient force pushing legs 313 and 317 away from one another, apex 315 of leg 313 is pushed toward the top corner 407 of box 400 such that the top end 403 of the support column lies in a fixed position relative to the top edge 409 of the box.

Leg 313 also defines a second support column extending in the direction of arrow 411 (which is generally in the width direction of box 400) between a top end 413 and a bottom end 415. Bottom end 415 is fixed relative to the top surface of article A, and top end 413 is fixed relative to the top edge 417 of box 400. The top end 403 of the lengthwise support column may be joined to the top end 413 of the widthwise support column, such as at the apex 315 of leg 313, which apex is positioned in the top corner 407 of the box. The leg 313 in each of the other chambers defines columns of support which are similar to these lengthwise and widthwise support columns. The support columns in each leg may be joined together at apexes 315 which lie in the other top corners of the box.

Leg 317 defines similar resilient columns of support between the corner R of article A and the bottom edges of box 400. That is, leg 317 defines a first support column extending in the direction of arrow 419 (which is generally in the length direction of box 400) between a top end 421 and a bottom end 423. Bottom end 423 lies in a fixed position relative to the bottom edge 425 of box 400, while top end 421 is fixed relative to the bottom surface of article A. Leg 317 also defines a support column extending in the direction of arrow 427 (which is generally in the width direction of box 400) between a top end 429 and a bottom end 431. Bottom end 431 lies in a fixed position relative to the bottom edge 433 of box 400, while top end 429 is fixed relative to the bottom surface of article A. The bottom end 423 of the lengthwise support column may be joined to the bottom end 431 of the widthwise support column, such as at the apex 319 of leg 317, which apex is positioned in the bottom corner 435 of box 400. The leg 317 in each of the other chambers 312 defines columns of support which are similar to these lengthwise and widthwise support columns, and which may be joined together at apexes 319 lying in the other bottom corners of the box.

Figure 13:
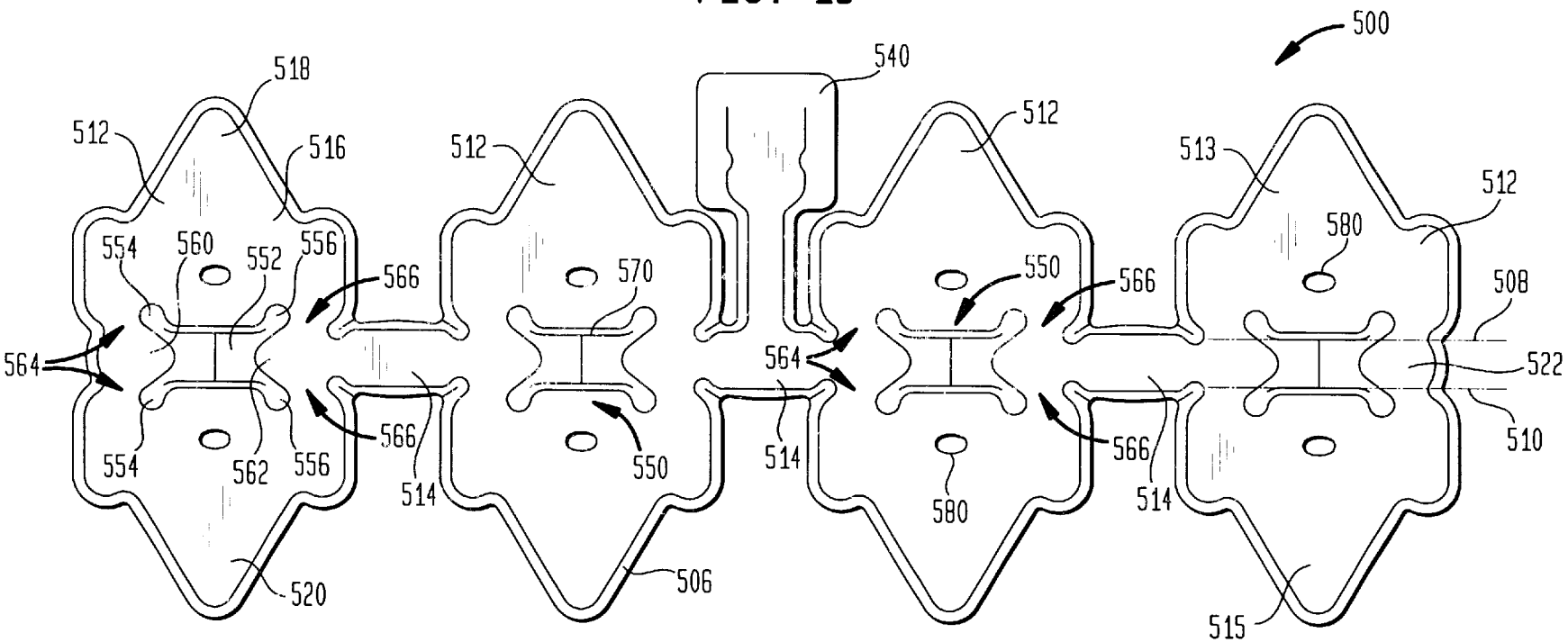
FIG. 13 is a top plan view of a packaging cushion in its deflated state in accordance with a third embodiment of the present invention.

A third embodiment of a cushion 500 in accordance with the present invention is shown in the deflated condition in FIG. 13. Cushion 500 is a wraparound style of cushion similar to cushion 300 described above, but rather than forming a completely enclosed ring in the inflated condition, cushion 500 is in the form of a series of chambers 512 interconnected with one another by inflatable passageways 514 so that they are aligned in a linear arrangement.

As with the cushions described above, cushion 500 may be formed from two sheets of thermoplastic material juxtaposed over one another and sealed together by heat sealing or other conventional techniques along weld line 506 to define the outer shape of chambers 512 and passageways 514. Each passageway 514 interconnects two adjacent chambers 512 so that the chambers are in flow communication with one another. The length of passageways 514 may vary depending upon the dimensions of the article A to be packaged, thereby enabling the positions of chambers 512 to be adjusted so as to correspond to the corners of the article.

Chambers 512 may have generally square major portions 516, with triangular portions 518 and 520 projecting outwardly therefrom in directions perpendicular to the length direction of cushion 500. However, chambers 512 are not limited to this particular shape, and may be formed with other shapes dictated by the size, shape, weight and other characteristics of the article to be packaged, the shape of the outer container and manufacturing considerations.

In addition to being sealed together along weld line 506, the thermoplastic sheets forming cushion 500 may be sealed together to define a sealed region 550 generally in the center of each chamber 512. Each sealed region 550 may have an elongated central portion 552 extending in the elongation direction of cushion 500, and first and second pairs of sealed projections 554 and 556 extending outwardly in diagonal directions from the opposite ends of central portion 552. Projections 554 define an inflatable tongue 560 therebetween and projections 556 define an inflatable tongue 562 therebetween. A first pair of narrow passageways 564 is defined between projections 554 and the opposed portion of weld line 506, and a second pair of narrow passageways 566 is defined between the ends of projections 556 and the opposed portions of weld line 506. Once sealed regions 550 have been formed, the thermoplastic sheets therein may be slit in a generally H-shaped pattern, as at 570, so as to define an opening 572 through the center of each chamber 512. As with the openings in cushion 300, openings 572 are intended to receive and support the corners of the article during shipping. Additional welded regions 580 may be formed in the major portions 516 and/or triangular portions 518 and 520 of chambers 512 to minimize the extent to which the sheets forming cushion 500 bulge away from one another, thereby controlling the overall inflated thickness of the chambers.

Cushion 500 may include an inflation valve 590 of the same type or types described above in connection with cushions 100 and 300. Although valve 590 may be positioned at any one of a number of locations along weld line 506, valve 590 preferably is positioned on the passageway 514 in the center of cushion 500 So that the cushion may be inflated rapidly by simultaneous inflation in two directions.

Cushion 500 exits the manufacturing process in a flat, deflated state, thereby occupying a minimum of space during shipping and storage. Once at the end user, cushion 500 may be inflated with a filler medium in a known fashion, and inflation valve 590 may be clamped or sealed to maintain the cushion in the inflated state. As with the cushions described above, the preferred filler medium is air, although cushion 500 may be filled with any liquid, gas, gel, expandable foam or other substance providing the properties desired for a particular application.

The inflation of cushion 500 causes a first portion or leg 513 of each chamber 512 to fold toward a second portion or leg 515 of the chamber. More particularly, leg 513 folds toward leg 515 along a fold line 508 extending through sealed region 550 and one each of passageways 564 and 566. Similarly, leg 515 folds towards leg 513 along a fold line 510 extending through sealed region 550 and the other ones of passageways 564 and 566. These folding actions leave an unfolded portion 522 in a center of each chamber 512, generally in alignment with passageways 514. The same considerations as described above are believed to be responsible for the folding of legs 513 and 515, namely, the relatively narrow size of passageways 564 and 566, as well as the tension in the thermoplastic sheets forming cushion 500.

Figure 14:
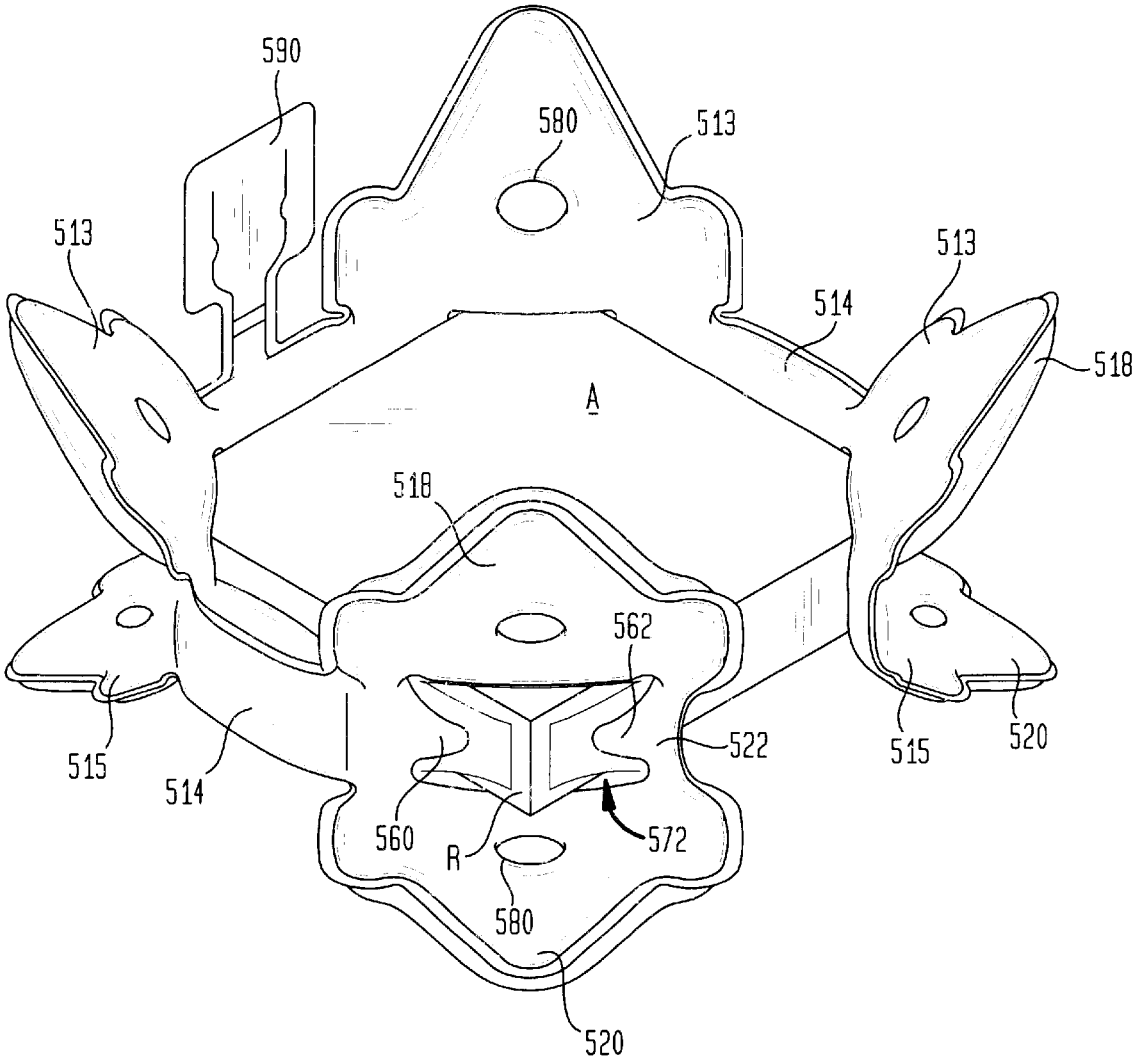
FIG. 14 is a perspective view of the packaging cushion of FIG. 13 in its inflated state surrounding an article to be packaged.

Once cushion 500 has been inflated, it may be assembled around an article so as to support the article in a suspended condition during shipping. More particularly, referring to FIG. 14, cushion 500 may be wrapped around an article A so that each corner R of the article is inserted into the opening 572 in a corresponding chamber 512. In this arrangement, inflated tongues 560 and 562 lie along the side edges of article A adjacent corners R, helping to hold chambers 512 in assembled position on the article. Furthermore, cushion 500 is assembled on article A so that the legs 513 and 515 of each chamber 512 project upwardly and outwardly and downwardly and outwardly, respectively, from the corners of the article. Once wrapped around the article, the entire assembly may be placed in an outer box or other container for shipping. When assembled in a box, each of the triangular portions 518 of chambers 512 preferably project into a corresponding top corner of the container, and each of the triangular portions 520 of chambers 512 preferably project into a bottom corner of the container. As with cushion 300 described above, in this assembled relationship, cushion 500 defines resilient columns of support which act in all of the orthogonal directions of the outer container. These columns of support have fixed end points so that they can only flex, but not translate, in reaction to an impact force in any direction, thereby protecting the supported article A from damage.

In addition to the several embodiments described above, the packaging structures of the present invention may be varied in many ways. For example, it will be appreciated that any of the features described in connection with a particular embodiment hereof may be incorporated in any other embodiment described herein. In one variant, sealed regions 356 may be formed with inflatable tongues at the opposite ends of central portion 358, such as the tongues 560 and 562 formed at the opposite ends of the sealed regions 550 in cushion 500. Alternatively, the sealed regions 550 in cushion 500 may be formed with inflatable tongues projecting away from triangular portions 518 and 520, as in the tongues 366 in cushion 300. It should be appreciated that sealed regions 356 and 550 may be formed with any desired shape in order to interact with and support the corners of a supported article in a desired fashion. Furthermore, any one of the packaging cushions described above may be provided with welded regions, such as welded regions 580, in order to control the overall thickness of specific regions of the cushion. It also will be appreciated that the chambers in cushions 300 and 500 may be interconnected by noninflatable straps rather than inflatable passageways, or may not be interconnected at all such that an independent chamber may be assembled on each corner of the article. In such event, each chamber may have its own inflation valve for inflating the chambers individually. Also, where the article to be packaged has an irregular shape or a nonrectangular shape, cushions 300 and 500 may be provided with more or less than four chambers as desired to adequately support and protect the article. The openings 370 in cushion 300 and the openings 572 in cushion 500 also may include tie straps (not shown) to help retain the corner R of article A, as shown in the aforementioned U.S. application Ser. No. 09/236,793.

Furthermore, while packaging cushions 100, 300 and 500 are all described above as being in the form of inflatable chambers, it will be appreciated that these cushions may be formed from any material having sufficient strength to support a packaged article while absorbing impact forces so as to prevent the article from becoming damaged. Such materials may absorb these impact forces by collapsing or deforming while preventing the article from impacting the outer container. Examples of such materials include polystyrene, expanded resinous foams and like materials which may be molded or otherwise formed to include the features of cushions 100, 300 or 500 described above. Preferred materials, however, are resilient and absorb such forces by resiliently deforming, again while preventing the article from impacting the outer container. Such resilient materials may include, for example, plastic foam materials, foam rubbers and the like, molded or otherwise formed to include the features of the cushions.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A packaging cushion for supporting at least one article, comprising a central portion extending generally in a horizontal plane and having an upwardly facing surface adapted to support the at least one article; and a plurality of resilient cushioning members each having one edge connected to said central portion and a free edge spaced from said central portion, each cushioning member projecting away from said central portion at an oblique angle, said oblique angles each having a first component extending parallel to said horizontal plane and a second component projecting downwardly from said horizontal plane;

said central portion including at least one web of material interconnecting said cushioning members, said at least one web of material including a plurality of apertures and being adapted to support the at least one article.

2. A packaging cushion for supporting at least one article, comprising a central portion extending generally in a horizontal plane and having an upwardly facing surface adapted to support the at least one article;

a plurality of resilient cushioning members each having one edge connected to said central portion and a free edge spaced from said central portion, each cushioning member projecting away from said central portion at an oblique angle, said oblique angles each having a first component extending parallel to said horizontal plane and a second component projecting downwardly from said horizontal plane;

said central portion including at least one web of material interconnecting said cushioning members, said at least one web of material being adapted to support the at least one article; and at least one slit dividing said at least one web of material into first and second portions, said first and second portions being adapted to receive the at least one article therebetween.

3. A packaging assembly, comprising a container having a sidewall, a bottom panel connected to said sidewall along a bottom edge, and a top panel connected to said sidewall along a top edge;

a cushion disposed in said container, said cushion having a central portion extending generally in a horizontal plane and a plurality of cushioning members each having one edge connected to said central portion and a free edge spaced from said central portion, each cushioning member projecting away from said central portion at an oblique angle, said oblique angles each having a first component extending parallel to said horizontal plane and a second component projecting downwardly from said horizontal plane so as to create a void space between said central portion and said bottom panel of said container; and at least one article supported on said central portion of said cushion, whereby said article is spaced from said bottom panel of said container.

4. The packaging assembly as claimed in claim 3, wherein said cushioning members are formed from a resilient material.

5. The packaging assembly as claimed in claim 4, wherein each of said cushioning members includes a hollow chamber containing a filler medium.

6. The packaging assembly as claimed in claim 3, wherein each of said cushioning members is separated from an adjacent cushioning member by a gap so that each of said cushioning members is movable away from said adjacent cushioning member.

7. The packaging assembly as claimed in claim 3, wherein said cushion is disposed in said container so that said free edges of said cushioning members are disposed at said bottom edge of said container.

8. The packaging assembly as claimed in claim 3, wherein said container sidewall includes a pair of opposed side panels extending in a length direction of said container and a pair of opposed end walls extending in a width direction of said container, said cushion including a pair of cushioning members each projecting away from said central portion toward one of said side panels, and a pair of cushioning members each projecting away from said central portion toward one of said end panels.

9. The packaging assembly as claimed in claim 3, wherein said container has a length direction and a width direction, said first component in ones of said cushioning members extending in said length direction of said container, and said first component in other ones of said cushioning members extending in said width direction of said container.

10. The packaging assembly as claimed in claim 3, wherein said first component is substantially equal to said second component.

11. A packaging assembly, comprising a container having a sidewall, a bottom panel connected to said sidewall along a bottom edge, and a top panel connected to said sidewall along a top edge;

a first cushion disposed in said container, said first cushion having a central portion extending generally in a horizontal plane and a plurality of cushioning members each having one edge connected to said central portion and a free edge spaced from said central portion, each cushioning member projecting away from said central portion at an oblique angle, said oblique angles each having a first component extending parallel to said horizontal plane and a second component projecting downwardly from said horizontal plane so as to create a void space between said central portion and said bottom panel of said container;

a second cushion disposed in said container, said second cushion having a central portion extending generally in a horizontal plane and a plurality of cushioning members each having one edge connected to said central portion and a free edge spaced from said central portion, each cushioning member projecting away from said central portion at an oblique angle, said oblique angles each having a first component extending parallel to said horizontal plane and a second component projecting upwardly from said horizontal plane so as to create a void space between said central portion and said top panel of said container; and at least one article positioned between said central portion of said first cushion and said central portion of said second cushion, whereby said article is spaced from said bottom and top panels of said container.

12. The packaging assembly as claimed in claim 11, wherein each of said cushioning members in said first cushion is separated from an adjacent cushioning member in said first cushion by a gap so that each of said cushioning members in said first cushion is movable away from said adjacent cushioning member in said first cushion.

13. The packaging assembly as claimed in claim 12, wherein each of said cushioning members in said second cushion is separated from an adjacent cushioning member in said second cushion by a gap so that each of said cushioning members in said second cushion is movable away from said adjacent cushioning member in said second cushion.

14. The packaging assembly as claimed in claim 13, wherein each of said cushioning members in said first and second cushions is formed from a resilient material.

15. The packaging assembly as claimed in claim 14, wherein in each of said cushioning members in said first and second cushions includes a hollow chamber containing a filler medium.

16. The packaging assembly as claimed in claim 15, wherein said hollow chamber in each one of said cushioning members in said first cushion is in flow communication with said hollow chambers in adjacent ones of said cushioning members in said first cushion, and said hollow chamber in each one of said cushioning members in said second cushion is in flow communication with said hollow chambers in adjacent ones of said cushioning members in said second cushion.

17. The packaging assembly as claimed in claim 16, further comprising a first access port in said first cushion for supplying said filler medium to said hollow chamber in each one of said cushioning members in said first cushion, and a second access port in said second cushion for supplying said filler medium to said hollow chamber in each one of said cushioning members in said second cushion.

18. The packaging assembly as claimed in claim 11, wherein said cushioning members in said first and second cushions each have a selected thickness and said central portions in said first and second cushions have a thickness less than said selected thickness.

19. The packaging assembly as claimed in claim 11, wherein said free edge of at least one of said cushioning members in said first cushion has end portions spaced from said central portion of said first cushion by a first distance and an intermediate portion between said end portions spaced from said central portion of said first cushion by a distance less than said first distance.

20. The packaging assembly as claimed in claim 19, wherein said intermediate portion defines a smooth arch.

21. The packaging assembly as claimed in claim 19, wherein said free edge of each of said cushioning members in said first cushion has end portions spaced from said central portion of said first cushion by selected distances and an intermediate portion between said end portions spaced from said central portion of said first cushion by a distance less than said selected distances.

22. The packaging assembly as claimed in claim 21, wherein each of said intermediate portions defines a smooth arch.

23. The packaging assembly as claimed in claim 19, wherein said free edge of at least one of said cushioning members in said second cushion has end portions spaced from said central portion of said second cushion by a second distance and an intermediate portion between said end portions spaced from said central portion of said second cushion by a distance less than said second distance.

24. The packaging assembly as claimed in claim 23, wherein said intermediate portion defines a smooth arch.

25. The packaging assembly as claimed in claim 23, wherein said free edge of each of said cushioning members in said second cushion has end portions spaced from said central portion of said second cushion by selected distances and an intermediate portion between said end portions spaced from said central portion of said second cushion by a distance less than said selected distances.

26. The packaging assembly as claimed in claim 25, wherein each of said intermediate portions defines a smooth arch.

27. The packaging assembly as claimed in claim 11, wherein said first cushion is disposed in said container so that said free edges of said cushioning members in said first cushion are disposed at said bottom edge of said container, and said second cushion is disposed in said container so that said free edges of said cushioning members in said second cushion are disposed at said top edge of said container.

28. The packaging assembly as claimed in claim 11, wherein said container sidewall includes a pair of opposed side panels extending in a length direction of said container and a pair of opposed end panels extending in a width direction of said container, said first cushion including a pair of cushioning members each projecting away from said central portion of said first cushion toward a respective one of said side panels, and a pair of cushioning members each projecting away from said central portion of said first cushion toward a respective one of said end panels, said second cushion including a pair of cushioning members each projecting away from said central portion of said second cushion toward a respective one of said side panels, and a pair of cushioning members each projecting away from said central portion of said second cushion toward a respective one of said end panels.

29. The packaging assembly as claimed in claim 11, wherein said container has a length direction and width direction, said first component in ones of said cushioning members in said first and second cushions extending in said length direction of said container, and said first component in other ones of said cushioning members in said first and second cushions extending in said width direction of said container.

30. A packaging assembly, comprising a container having a sidewall, a bottom panel connected to said sidewall along a bottom edge, and a top panel connected to said sidewall along a top edge;

a series of cushions arranged one on top of another to form a stack in said container, each cushion having a central portion extending generally in a horizontal plane and a plurality of cushioning members each having one edge connected to said central portion and a free edge spaced from said central portion, said cushioning members each projecting away from said central portion at an oblique angle, said oblique angles each having a first component extending parallel to said horizontal plane and a second component projecting downwardly from said horizontal plane, whereby a void space is created between a bottommost cushion in said stack and said bottom panel of said container;

at least one article supported on said central portion of at least one of said cushions in said series of cushions; and a final cushion assembled in said container on top of said stack, said final cushion having a central portion extending generally in a horizontal plane and a plurality of cushioning members each having one edge connected to said central portion and a free edge spaced from said central portion, each cushioning member projecting away from said central portion at an oblique angle, said oblique angles each having a first component extending parallel to said horizontal plane and a second component projecting upwardly from said horizontal plane so as to create a void space between said central portion and said top panel of said container.

31. The packaging assembly as claimed in claim 30, further comprising at least one article supported on said central portion of each cushion in said series of cushions.

32. The packaging assembly as claimed in claim 30, wherein said at least one cushion in said series of cushions supports an adjacent overlying cushion so that said central portion of said adjacent overlying cushion is spaced above said at least one article.

33. The packaging assembly as claimed in claim 30, wherein an adjacent overlying cushion to said at least one cushion is supported so that said central portion of said adjacent overlying cushion is in contact with said at least one article, and said cushioning members of said adjacent overlying cushion are spaced above said cushioning members of said at least one cushion.

34. A packaging assembly, comprising a container having a top panel, a bottom panel and a sidewall including a first pair of opposed side panels extending in a length direction and a second pair of opposed side panels extending in a width direction;

an article disposed in said container; and at least one cushion positioned between said article and said container for supporting said article in a suspended position in said container, at least a first portion of said at least one cushion defining at least a first resilient arch between said article and one of said side panels in said first pair, said first arch including a pair of ends contacting said one side panel at spaced locations and an intermediate portion spaced from said one side panel, at least a second portion of said at least one cushion defining at least a second resilient arch between said article and another of said side panels in said first pair, said second arch including a pair of ends contacting said another side panel at spaced locations and an intermediate portion spaced from said another side panel; and said at least one cushion including a central portion intermediate said first and second portions, said first portion, said side portion and said central portion together defining a third arch between said article and said bottom panel of said container with said first and second portions of said at least one cushion contacting said bottom panel at spaced locations and said central portion being spaced from said bottom panel.

35. A packaging assembly, comprising a container having a top panel, a bottom panel and a sidewall including a first pair of opposed side panels extending in a length direction and a second pair of opposed side panels extending in a width direction;

an article disposed in said container; and at least one cushion positioned between said article and said container for supporting said article in a suspended position in said container, said at least one cushion including perimeter portions and a central portion intermediate said perimeter portions, said perimeter portions defining at least one resilient first arch between said article and each of said side panels of said container, each of said first arches including a pair of ends contacting one of said side panels at spaced locations and an intermediate portion spaced from said one of said side panels, at least two of said perimeter portions and said central portion together defining a resilient bottom arch between said article and said bottom panel of said container with said at least two perimeter portions contacting said bottom panel at spaced locations and said central portion being spaced from said bottom panel.

36. The packaging assembly as claimed in claim 35, wherein said perimeter portions and said central portion together define a pair of resilient bottom arches between said article and said bottom panel of said container, one of said pair of bottom arches having an axis of curvature extending in said length direction, and another of said pair of bottom arches having an axis of curvature extending in said width direction.

37. A packaging assembly, comprising a container having a top panel, a bottom panel and a sidewall including a first pair of opposed side panels extending in a length direction and a second pair of opposed side panels extending in a width direction;

an article disposed in said container;

a first cushion positioned between said article and said container for supporting said article in a suspended position in said container, perimeter portions of said first cushion defining at least one resilient first arch between said article and each of said side panels of said container, each of said first arches including a pair of ends contacting one of said side panels at spaced locations and an intermediate portion spaced from said one of said side panels; and another cushion positioned between said article and said container, perimeter portions of said another cushion defining at least one resilient second arch between said article and each of said side panels of said container, each of said second arches including a pair of ends contacting one of said side panels at spaced locations and an intermediate portion spaced from said one of said side panels.

38. The packaging assembly as claimed in claim 37, wherein said another cushion includes a central portion intermediate said perimeter portions, at least two of said perimeter portions and said central portion of said another cushion together defining a resilient top arch between said article and said top panel of said container with said at least two perimeter portions of said another cushion contacting said top panel at spaced locations and said central portion of said another cushion being spaced from said top panel.

39. The packaging assembly as claimed in claim 38, wherein said perimeter portions and said central portion of said another cushion together define a pair of resilient top arches between said article and said top panel of said container, one of said pair of top arches having an axis of curvature extending in said length direction, and another of said pair of top arches having an axis of curvature extending in said width direction.

40. The packaging assembly as claimed in claim 39, wherein said at least one cushion includes a central portion intermediate said perimeter portions, at least two of said perimeter portions and said central portion of said at least one cushion together defining a resilient bottom arch between said article and said bottom panel of said container with said at least two perimeter portions of said at least one cushion contacting said bottom panel at spaced locations and said central portion of said at least one cushion being spaced from said bottom panel.

41. The packaging assembly as claimed in claim 40, wherein said perimeter portions and said central portion of said at least one cushion together define a pair of bottom arches between said article and said bottom panel of said container, one of said pair of bottom arches having an axis of curvature extending in said length direction, and another of said pair of bottom arches having an axis of curvature extending in said width direction.

42. The packaging assembly as claimed in claim 37, wherein said at least one cushion and said another cushion together define a third resilient arch between said article and each of said side panels of said container, ones of said third arches having an axis of curvature extending in said length direction and others of said third arches having an axis of curvature extending in said width direction.

* * * * *

UNITED STATES PATENT AND TRADEMARK OFFICE

CERTIFICATE OF CORRECTION

PATENT NO. : 6,398,029 B1
DATED : June 4, 2002
INVENTOR(S) : Farison, Brian Kent et al.

It is certified that error appears in the above-identified patent and that said Letters Patent is hereby corrected as shown below:

Column 14,
Line 33, "a" should read -- α --.

Signed and Sealed this

Fourteenth Day of January, 2003

JAMES E. ROGAN
*Director of the United States Patent and Trademark Office*